US011819466B2

(12) United States Patent
Pang et al.

(10) Patent No.: US 11,819,466 B2
(45) Date of Patent: Nov. 21, 2023

(54) SAFETY SYSTEM FOR A BATHROOM FACILITY TRANSFER SYSTEM

(71) Applicant: Raz Design Inc., Toronto (CA)

(72) Inventors: Nelson W. H. Pang, Toronto (CA); Ethan David Maiolo, Stouffville (CA); David James Harding, Toronto (CA); Lukas Jeroen ten Kortenaar, North York (CA); Steven Yi, Toronto (CA)

(73) Assignee: RAZ DESIGN INC., Toronto (CA)

( * ) Notice: Subject to any disclaimer, the term of this patent is extended or adjusted under 35 U.S.C. 154(b) by 58 days.

(21) Appl. No.: 17/557,283

(22) Filed: Dec. 21, 2021

(65) Prior Publication Data

US 2022/0192907 A1 Jun. 23, 2022

(30) Foreign Application Priority Data

Dec. 21, 2020 (CA) ..... CA 3103401

(51) Int. Cl.
*A61G 7/10* (2006.01)
*A47K 3/12* (2006.01)

(52) U.S. Cl.
CPC ..... *A61G 7/1003* (2013.01); *A47K 3/122* (2013.01); *A61G 7/1007* (2013.01); *A61G 7/1034* (2013.01); *A61G 7/1059* (2013.01)

(58) Field of Classification Search
CPC .. A61G 7/1003; A61G 7/1007; A61G 7/1034; A61G 7/1059; A47K 3/122
See application file for complete search history.

(56) References Cited

U.S. PATENT DOCUMENTS 5,373,591 A * 12/1994 Myers ..... A47K 3/122 4/578.1
5,940,905 A * 8/1999 Cheng ..... A47K 3/122 4/578.1
2019/0350411 A1 11/2019 Hart et al.

FOREIGN PATENT DOCUMENTS

CA 2969015 A1 12/2018

OTHER PUBLICATIONS

European Search Report of Application No. 21216550.0 dated May 5, 2022.

* cited by examiner

*Primary Examiner* — Erin Deery
(74) *Attorney, Agent, or Firm* — Lippes Mathias LLP

(57) ABSTRACT

A bathroom facility transfer system, including a mobile base, a stationary base, and a removable bridge is disclosed. A user seated in a chair, is positioned adjacent to a bathroom facility with the mobile base. The removable bridge connects the mobile base to the stationary base, which is removably affixed to the bathroom facility, to allow the chair carrying the user to be moved between the mobile base and the stationary base. A chair blocking member on the removable base is movable between a) a chair blocking position, and b) a chair unblocking position. At least one opposed end of the chair blocking member interferes with movement of the chair onto the removable bridge from the mobile base or the stationary base, when the chair blocking member is in the chair blocking position. A method of assisting a user with accessing a bathroom facility is also disclosed.

54 Claims, 11 Drawing Sheets

Fig. 7

SAFETY SYSTEM FOR A BATHROOM FACILITY TRANSFER SYSTEM

This application claims priority to Canadian Patent Application No. 3,103,401, filed Dec. 21, 2020, the content of which is incorporated herein in its entirety.

FIELD OF THE INVENTION

The present invention relates to the field of transfer systems for the purpose of assisting persons with disabilities with accessing bathroom facilities without having to transfer from one apparatus to another apparatus. More particularly, the present invention relates to a safety system for such transfer systems.

BACKGROUND OF THE INVENTION

Disabled persons with certain mobility issues require assistance with using bathroom facilities, including, for example, a toilet, a bathtub, and a shower.

There are several known devices for transferring a disabled person from one location to a bathroom facility, and granting the disabled person access to the bathroom facility.

Some known devices allow the disabled person to be moved from the one location to a location in which the bathroom facility is kept, using some form of wheeled chair. Typically, the disabled person must then be transferred from the wheeled chair to some form of transfer apparatus, which is configured to place him or her in a desired position relative to the bathroom facility to access the bathroom facility. However, transferring the disabled person from the wheeled chair to the transfer apparatus is difficult work, requiring care givers to engage in heavy lifting of the disabled person to transfer him or her out of the wheeled chair and onto the transfer apparatus, and vice versa. Often a separate patient lift device is employed to assist with transferring a disabled person from the wheeled chair to the transfer apparatus, before the transfer apparatus can be used to place the disabled person in a desired position relative to the bathroom facility.

U.S. Pat. No. 7,690,055 to Hammer, disclosed one attempt at overcome the above noted problem of transferring a disabled person from the wheeled chair to the bathroom facility, present in the prior art devices. Hammer, disclosed a portable bath transfer system that provides a disabled person access to bathroom facilities without having to transfer apparatus.

The Hammer bath transfer system comprises a chair portion, a connector bridge portion, and a bathtub portion. The chair portion includes a base section with two or more support members and an upper chassis section including an adjustable backrest, a collapsible chair seat, and two swing-away armrests. The connector bridge portion includes connecting members attached by a cross member. The bathtub portion includes a base and four adjustable support members.

The chair portion can be positioned adjacent to a bathtub containing the bathtub portion located therein. The connector bridge portion can then be attached to the chair portion and the bathtub portion to provide a bridge for the upper chassis to slidably translate over bathtub portion. Before a user is positioned over bathtub portion, latch slides are engaged with anti-roll latches to prevent the connector portion from lifting or separating from bathtub portion or the chair portion.

In this way, the Hammer bath transfer system enables transferring the disabled person to and from the bathtub without requiring care givers to do any heavy lifting, and without needing to use additional transfer or lifting apparatus.

However, a problem with the Hammer bath transfer system, and other similar devices which include a removable connector bridge portion connecting a chair portion to a bathtub portion is that they lack a safety system that prevents slidable translation of the upper chassis onto the removable connector bridge portion unless the connection of the removable connector bridge portion to the chair portion and the bathtub portion is secured at both ends. Allowing the chair portion to translate onto the removable connector bridge portion when it is not correctly secured at one or both ends can have devastating consequences for the disabled person using the system. For example, if the removable connector bridge is securely connected to the bathtub portion, but not to the chair portion, and the upper chassis is moved from the bathtub portion onto the removable connector bridge, toward the chair portion, the upper chassis can fall off the removable connector bridge before making it safely to the chair portion. Were that to occur, the disabled person seated in the upper chassis would likely fall to the ground and sustain severe injuries.

Other examples of known bath transfer systems include those disclosed in: U.S. Pat. No. 5,373,591 (Myers), U.S. Pat. No. 6,334,225 (Brinkmann), U.S. Pat. No. 7,506,385 (Werschmidt), U.S. Pat. No. 7,980,584 (Goldstein), U.S. Pat. No. 9,545,350 (Walters), U.S. Pat. No. 10,368,699 (Hart), and U.S. Pat. No. 10,694,897 (Hart); U.S. Design Pat. No. 611,715 (Werschmidt); German Pat. App. Pub. No. DE102017124271 (Chan); Japanese Pat. No. 6703324 (Haruta); Chinese Pat. App. Pub. No. CN109199749 (Zhan); and PCT Int'l Pat. App. Pub. No. WO2018/218331 (Maiolo).

Additional examples include those disclosed online at:

https://www.healthproductsforyou.com/p-columbia-versa-bath-shower-and-commode-transfer-system.html, https://www.healthproductsforyou.com/p-columbia-omni-reclining-bath-shower-and-commode-transfer-system.html, https://www.rehabmart.com/product/deluxe-all-purpose-tiltinspace-shower-transfer-chair-21076.html, and https://www.vitalitymedical.com/eagle-health-swivel-sliding-transfer-bench-regular-extra-long.html?network=g&device=c&keyword=&campaign=916499233&adgroup=pla-342593351175&gclid=EAIalQobChMIgNiS4Jzz6gIVAdvACh3Z4wR 2EAQYBCABEgKQlfD_BwE.

However, there is a continuing need for improvements in transfer systems designed to assist persons having certain disabilities with accessing bathroom facilities.

SUMMARY OF THE INVENTION

What is desired is a safety system for a transfer system designed to assist disabled persons with accessing bathroom facilities, that is inexpensive to manufacture, simple to operate, and effective.

The desired safety system will prevent movement of a chair of the transfer system onto a removable bridge connecting a mobile base and a stationary base, unless the removable bridge is correctly secured to both the mobile base and the stationary base.

Accordingly, an embodiment of the present invention is directed to a transfer system designed to assist a user having a disability with accessing a bathtub. The transfer system includes a chair, a mobile base, a stationary base, and a removable bridge. The mobile base is used to position the user seated in the chair, adjacent to the bathtub. The stationary base is preferably disposed inside the bathtub, and affixed thereto. With the user positioned adjacent to the bathtub, on the mobile base, while seated in the chair, the removable bridge is removably connected to the mobile base and the stationary base.

Latch members on the removable bridge are used to secure the connection of the removable bridge to the mobile base and the stationary base. Each latch member is resiliently biased to a first position, and movable to a second position by latching to a corresponding catch member on the mobile base or the stationary base.

A chair blocking member, also on the removable bridge, is movable between a) a chair blocking position, and b) a chair unblocking position. The first position of each of the latch members interferes with moving the chair blocking member to the chair unblocking position. In this way, movement of the chair onto the removable bridge from the mobile base and the stationary base is prevented unless both the first and second latch members are in their second positions, and the chair blocking member is in its chair unblocking position.

However, once the connection of the removable bridge to the mobile base and the stationary base is secured with the latch members, thereby removing the interference with the movement of the chair blocking member to its chair unblocking position, and the chair blocking member is moved to the chair unblocking position, the chair, carrying the user, is allowed to be moved between the mobile base and the stationary base.

After the user, seated in the chair, is moved to the stationary base, the chair blocking member is moved to the chair blocking position, and the latch members are unlatched from their respective catch members to allow the latch members to be biased to their first positions. The removable bridge is then removed and stowed out of the way. The mobile base may also be moved out of the way at that point.

When the user ceases to require access to the bathtub, he or she may be transferred back to the mobile base in a similar fashion. In particular, the mobile base may be positioned adjacent to the bathtub, and the removable bridge may be connected to the mobile base and the stationary base. Once the connection of the removable bridge to the mobile base and the stationary base is secured with the latch members, thereby removing the interference with the movement of the chair blocking member to its chair unblocking position, and the chair blocking member is moved to the chair unblocking position, the chair, with the user seated therein, is allowed to be moved between the mobile base and the stationary base.

The user, seated in the chair, is then moved to the mobile base, the chair blocking member is moved to the chair blocking position, and the latch members are unlatched from their respective catch members to allow the latch members to be biased to their first positions. The removable bridge is then removed and stowed out of the way, and the mobile base, carrying the user seated in the chair, is moved away from the bathtub to another location.

Although the present invention is taught in relation to a bathroom facility in the form of a bathtub, it will be appreciated by persons skilled in the art that the present teachings apply to other bathroom facilities, including, without limitation, a shower stall, a toilet, and the like. All such embodiments are comprehended by the present invention.

Therefore, in accordance with one aspect of the present intention, there is disclosed a transfer system to assist a user with accessing a bathroom facility, said transfer system comprising:

a mobile base configured to be maneuvered to a position adjacent to said bathroom facility;

a stationary base configured to remain in a fixed position relative to said bathroom facility;

a removable bridge configured to connect said mobile base to said stationary base, such that said mobile base, said removable bridge, and said stationary base together define a path between said mobile base and said stationary base;

a chair for said user, said chair being movable along said path; and a chair blocking member attached to said removable bridge, extending between opposite ends of said removable bridge, said chair blocking member having opposed ends, and being movable between:

a) a chair blocking position, wherein at least one of said opposed ends interferes with a movement of said chair onto said removable bridge from said mobile base or said stationary base; and b) a chair unblocking position, wherein said opposed ends remain clear of said chair to permit said movement of said chair onto said removable bridge from said mobile base and said stationary base.

The above transfer system may further comprise:

a latching system configured to secure said connection of said removable bridge to said mobile base and said stationary base, said latching system comprising:

first and second latch members attached to opposite ends of said removable bridge for latching to corresponding first and second catch members attached to said mobile base and said stationary base, each of said first and second latch members being resiliently biased to a first position, and movable to a second position by latching to said corresponding catch member;

wherein said first position of each of said first and second latch members interferes with a movement of said chair blocking member to said chair unblocking position;

whereby said latching system prevents said movement of said chair onto said removable bridge from said mobile base or said stationary base unless both said first and second latch members are in said second positions, and said chair blocking member is in said chair unblocking position.

In accordance with another aspect of the present invention, there is disclosed a method of assisting a user with accessing a bathroom facility, said method comprising the steps of:

providing a stationary base in a fixed position relative to said bathroom facility;

seating said user in a chair supported by a mobile base;

maneuvering said mobile base to a position adjacent to said bathroom facility with said user seated in said chair and said chair being supported by said mobile base;

connecting a first end of a removable bridge to said mobile base, and a second end of said removable bridge to said stationary base, such that said mobile base, said removable bridge, and said stationary base together define a path for said chair to move along between said mobile base and said stationary base;

blocking said path with a chair blocking member attached to said removable bridge, extending between opposite ends of said removable bridge, to prevent said chair from being moved onto said removable bridge until said connection of said removable bridge to said mobile base and said stationary base is secured;

wherein said chair blocking member has opposed ends, and is movable between:

a) a chair blocking position, wherein at least one of said opposed ends interferes with a movement of said chair onto said removable bridge from said mobile base or said stationary base; and b) a chair unblocking position, wherein said opposed ends remain clear of said chair to permit said movement of said chair onto said removable bridge from said mobile base and said stationary base.

The above method may further comprise the step of:

securing said connection by latching first and second latch members attached to said opposite ends of said removable bridge, to corresponding first and second catch members attached to said mobile base and said stationary base, each of said first and second latch members being resiliently biased to a first position, and movable to a second position by said latching to said corresponding first or second catch member;

wherein said first position of each of said first and second latch members interferes with a movement of said chair blocking member to said chair unblocking position;

whereby said method prevents said movement of said chair onto said removable bridge from said mobile base or said stationary base unless both said first and second latch members are in said second positions, and said chair blocking member is in said chair unblocking position.

BRIEF DESCRIPTION OF THE DRAWINGS

Reference will now be made by way of example only to preferred embodiments of the invention by reference to the following drawing in which.

DETAILED DESCRIPTION OF THE PREFERRED EMBODIMENTS

The present invention is described in more detail with reference to exemplary embodiments thereof as shown in the appended drawings. While the present invention is described below including preferred embodiments, it should be understood that the present invention is not limited thereto. Those of ordinary skill in the art having access to the teachings herein will recognize additional implementations, modifications, and embodiments which are within the scope of the present invention as disclosed and claimed herein.

Figure 1:
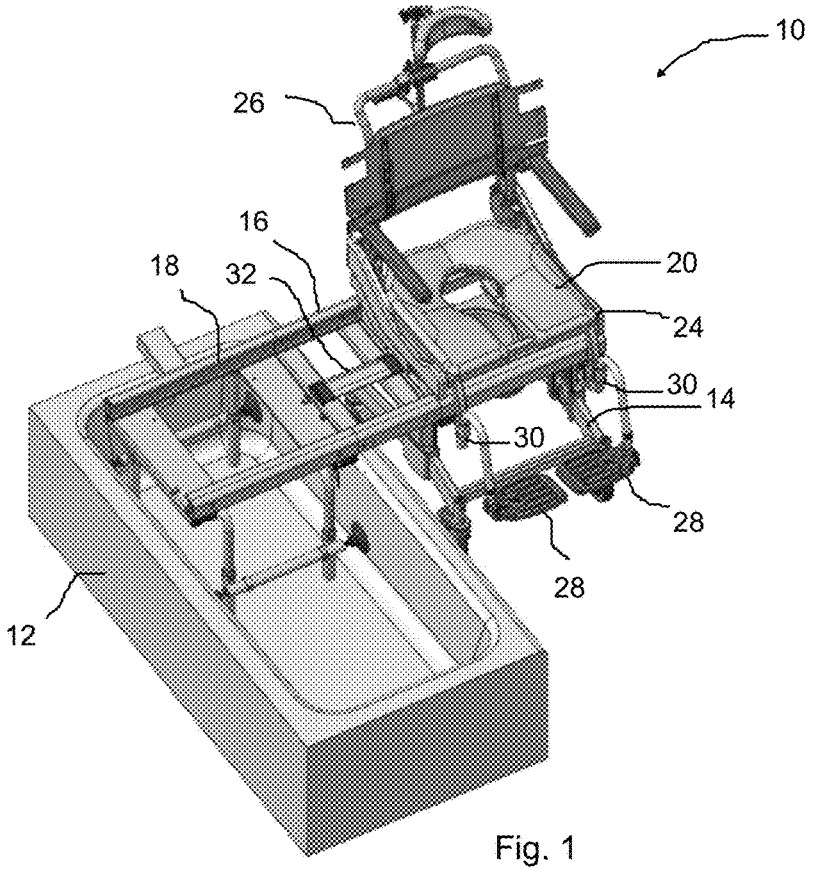
FIG. 1 is a perspective view of a transfer system according to an embodiment of the present invention, showing a mobile base positioned adjacent to a bathtub, a stationary base affixed to the inside of the bathtub, a removable bridge connected to the mobile base and the stationary base, a chair blocking member of a latching system in a chair unblocking position, and a chair attached to the mobile base, which is movable along a path defined by the mobile base, the removable bridge, and the stationary base.

A bath transfer system according to an embodiment of the present invention is shown generally with reference numeral 10 in FIG. 1. As can be seen, the bath transfer system 10 is configured to assist a user with accessing a bathroom facility 12, which in this example is in the form of a bathtub. Other examples of bathroom facilities 12 include, a shower stall, a toilet, and the like. The bath transfer system 10 includes, a mobile base 14, a removable bridge 16, a stationary base 18, and a chair 20. The preferred stationary base 18 will be configured to remain in a fixed position relative to the bathroom facility 12. The removable bridge 16 is preferably configured to connect the mobile base 14 to the stationary base 18.

Preferably, the mobile base 14 may be configured to be maneuvered to a position adjacent to the bathroom facility 10. In this regard, the term adjacent carries its ordinary meaning of "close to or near something". In this example, the mobile base 14 is configured to be maneuvered to a position beside a bathroom facility, such as for example a bathtub, as shown in FIG. 1. However, in other embodiments the mobile base 14 may be configured to be maneuvered to, for example above or over top of a bathroom facility, such as for example a toilet. All such embodiments are comprehended by the present invention.

Figure 2:
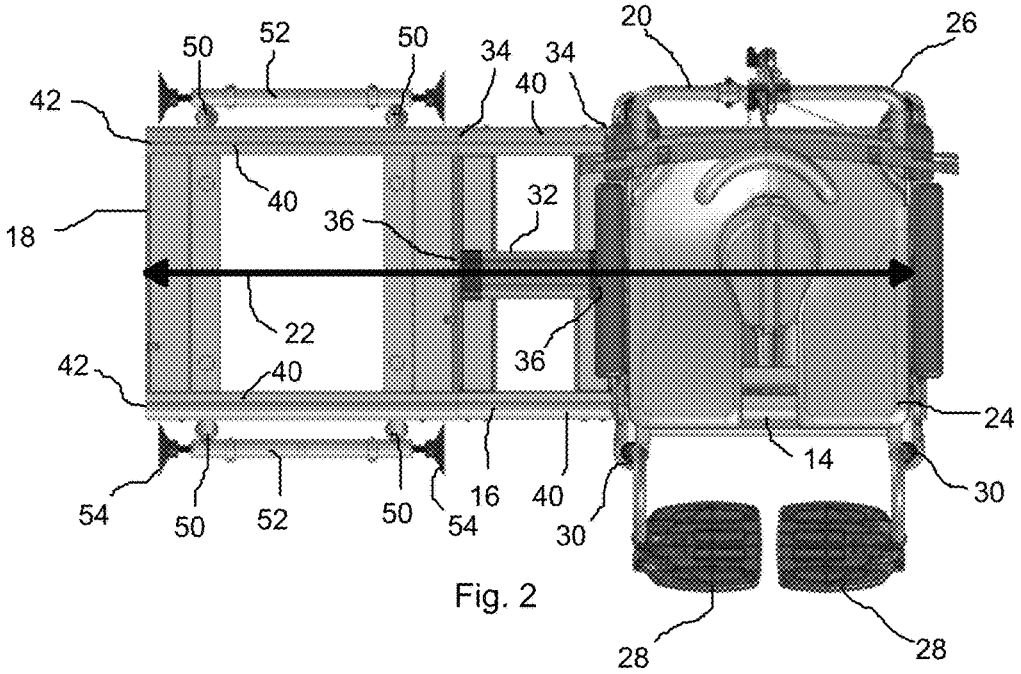
FIG. 2 is a top view of the transfer system of FIG. 1, limited to the transfer system.
Figure 3:
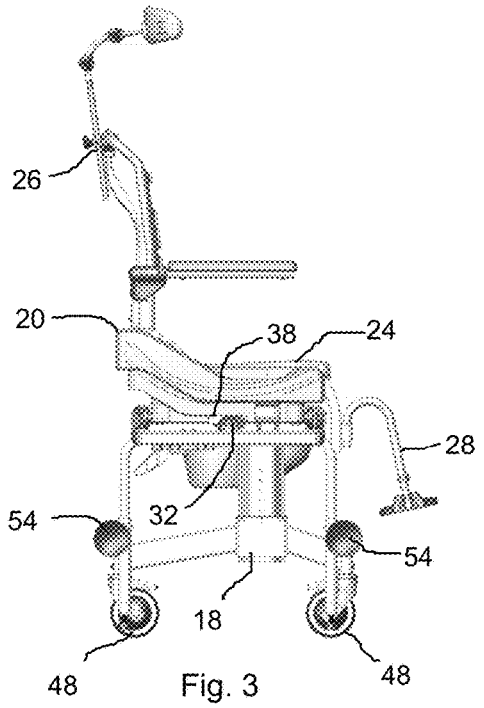
FIG. 3 is a right side view of the transfer system of FIG. 2.
Figure 4:
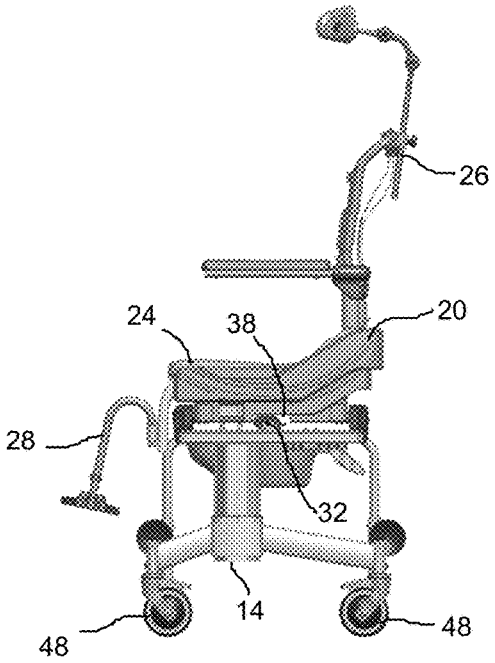
FIG. 4 is a left side view of the transfer system of FIG. 2.
Figure 5:
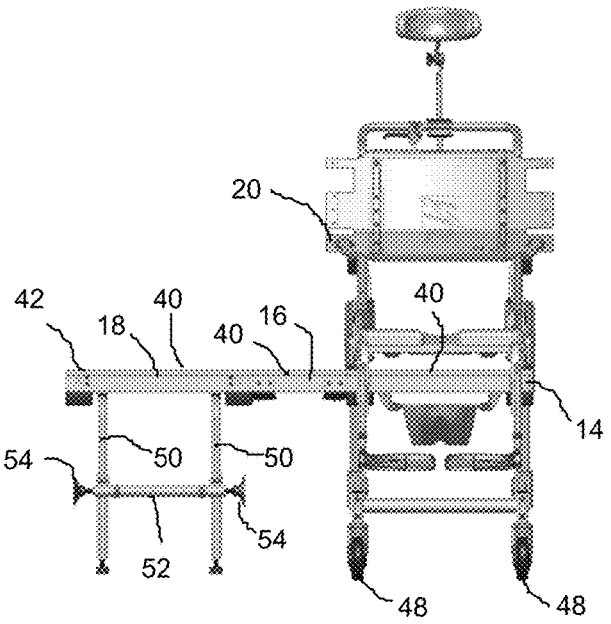
FIG. 5 is a front view of the transfer system of FIG. 2.
Figure 6:
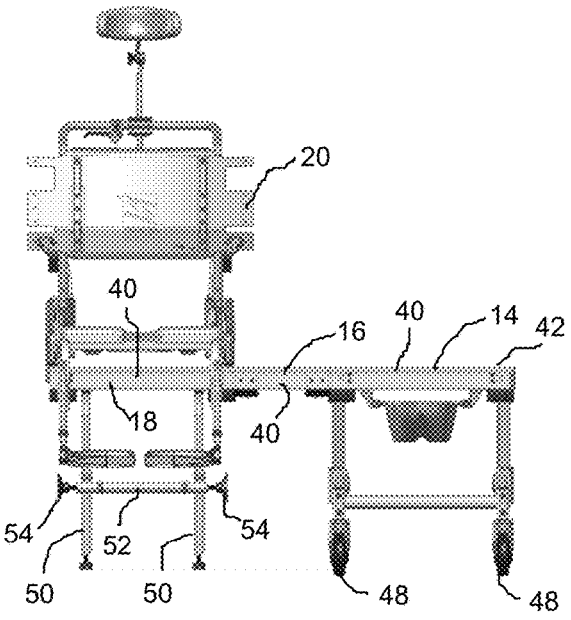
FIG. 6 is a front view of the transfer system of FIG. 5, showing the chair after having been moved along the path from the mobile base to the stationary base.
Figure 7:
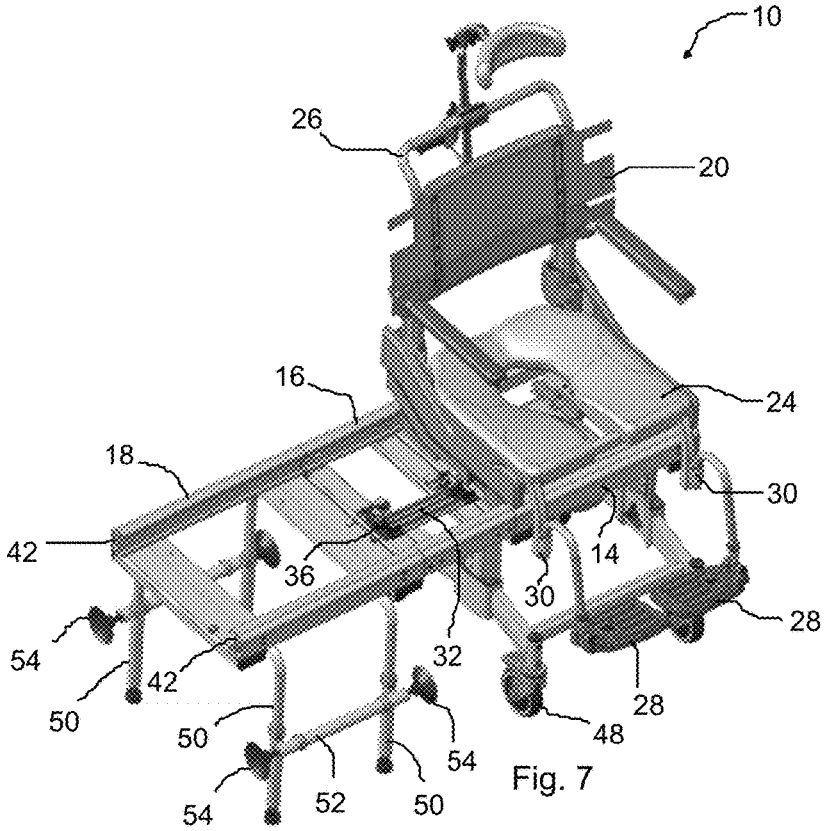
FIG. 7 is a perspective view of the transfer system of FIG. 2, showing the chair blocking member of the latching system in a chair blocking position.
Figure 8:
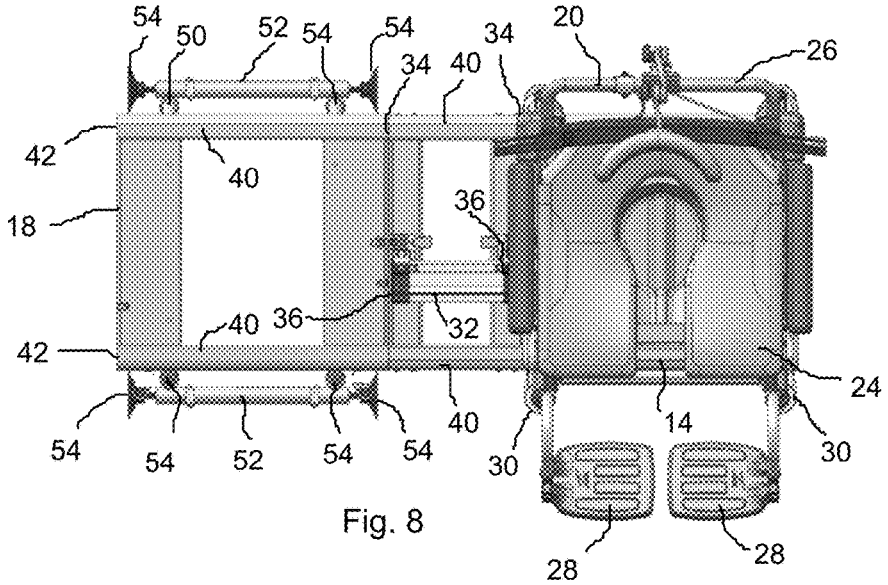
FIG. 8 is a top view of the transfer system of FIG. 7.
Figure 9:
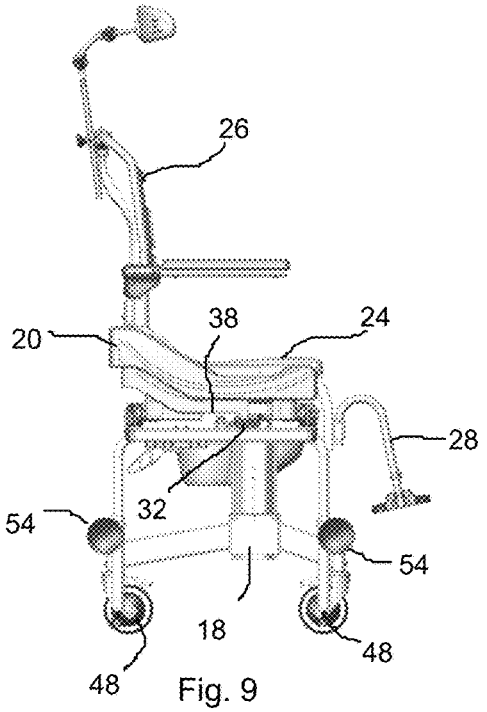
FIG. 9 is a right side view of the transfer system of FIG. 7.
Figure 10:
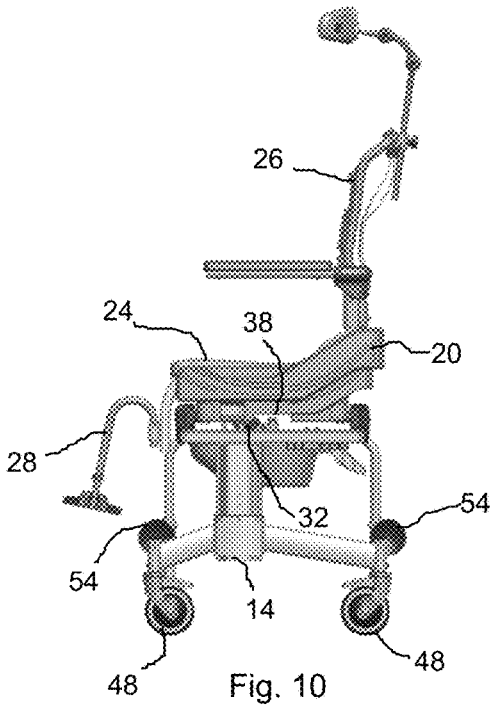
FIG. 10 is a left side view of the transfer system of FIG. 7.

As best seen in FIG. 2, when the removable bridge 16 is connected to the mobile base 14 and the stationary base 18 in this manner, the mobile base 14, the removable bridge 16, and the stationary base 18 together define a path 22 between the mobile base 14 and the stationary base 18. The chair 20 is configured to carry the user in a seated position, and is movable along the path 22 between mobile base 14 and the stationary base 18, when the connection of the removable bridge 16 to the mobile base 14 and the stationary base 18 is secured. The chair 20 has a seat 24, a backrest 26, and foot rests 28, removably held in holders 30. The removable foot rests 28 may be used as needed, and removed from the holders 30 so as not to interfere with the movement of the chair 20 between the mobile base 14 and the stationary base 18.

Figure 36:
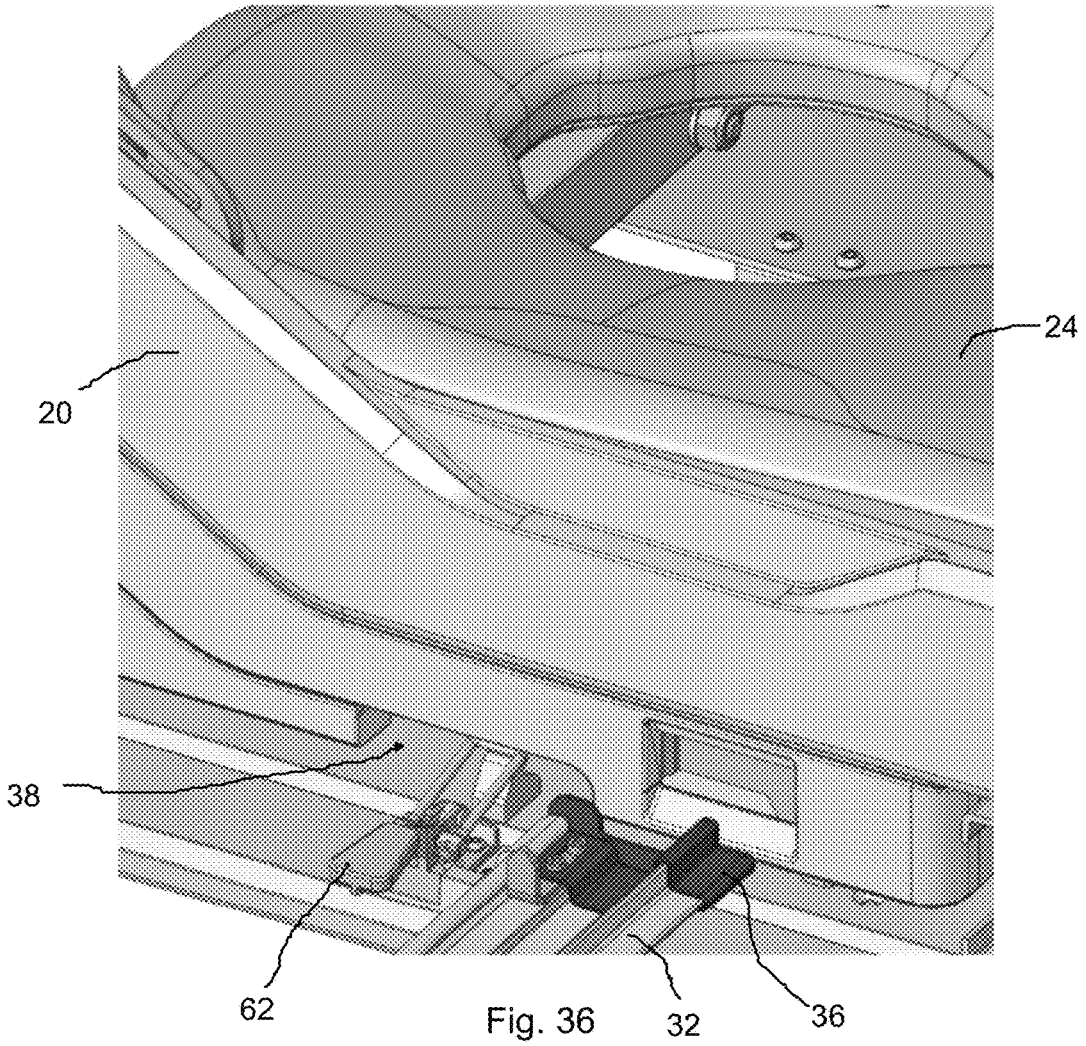
FIG. 36 is a perspective view of a detail of the transfer system of FIG. 7.

A chair blocking member 32 is preferably attached to the removable bridge 16 so as to extend between the opposite ends 34 of the removable bridge 16. As discussed in more detail below, the chair blocking member 32 has opposed ends 36, and is movable between a) a chair blocking position (see FIGS. 7-10, and especially FIGS. 36 and 37), wherein the opposed ends 36 interfere with a movement of the chair 20 onto the removable bridge 16 from the mobile base 14 and the stationary base 18, and b) a chair unblocking position (see FIGS. 1-6, and especially FIGS. 38 and 39), wherein the opposed ends 36 remain clear of the chair 20 to permit the movement of the chair 20 onto the removable bridge 16 from the mobile base 14 and the stationary base 18. Preferably, the opposed ends 36 of the chair blocking member 32 may be positioned adjacent the opposite ends 34 of the removable bridge 16, as shown.

Although it is preferable to configure the chair blocking member 32 so that when the chair blocking member 32 is in the chair blocking position one of the opposed ends 36 will interfere with the movement of the chair 20 onto the removable bridge 16 from the mobile base, and the other of the opposed ends 36 will interfere with the movement of the chair 20 onto the removable bridge 16 from the stationary base 18, it is contemplated that in at least some embodiments, it may be acceptable to configure the chair blocking member 32 such that only one of the opposed ends 36 will interfere with the movement of the chair 20 onto the removable bridge 16 from either the mobile base 16, or the stationary base 18. All such embodiments are comprehended by the present invention.

Referring now to FIGS. 2 to 5, the bath transfer system 10 is shown with the removable bridge 16 connected to the mobile base 14 and the stationary base 18, and the chair 20 being supported by the mobile base 14. With the connection of the removable bridge 16 secured, and the chair blocking member 32 in the chair unblocking position, the chair 20 is movable from the mobile base 14 (shown in FIGS. 2-5), to the stationary base 18 (shown in FIG. 6), and vice versa. Preferably, the chair 20 defines a void sized and shaped to allow the chair 20 to pass over the opposed ends 36 of the chair blocking member 32, when the chair blocking member 32 is in the chair unblocking position. As best seen in FIGS. 3, 4, 38, and 39, the void may be a channel formed in a bottom of the chair 20.

Referring back to FIG. 2, the path 22 is preferably defined by a plurality of track members 40, and the chair 20 has rolling means configured to engage the plurality of track members 40, to allow the chair 20 to be moved along the path 22 between the mobile base 14 and the stationary base 18, in a known manner. For example, one or more track members 40 may be provided on the mobile base 14, one or more track members 40 may be provided on the removable bridge 16, and one or more track members 40 may be provided on the stationary base 18, and the rolling means on the chair 20 may be configured to engage the plurality of track members 40, to allow the chair to be moved along the path 22. However, good results have been obtained using pairs of track members 40 arranged in parallel on each of the mobile base 14, the removable bridge 16, and the stationary base 18, wherein the pairs of track members 40 are aligned into two parallel tracks 42, as shown.

Figure 37:
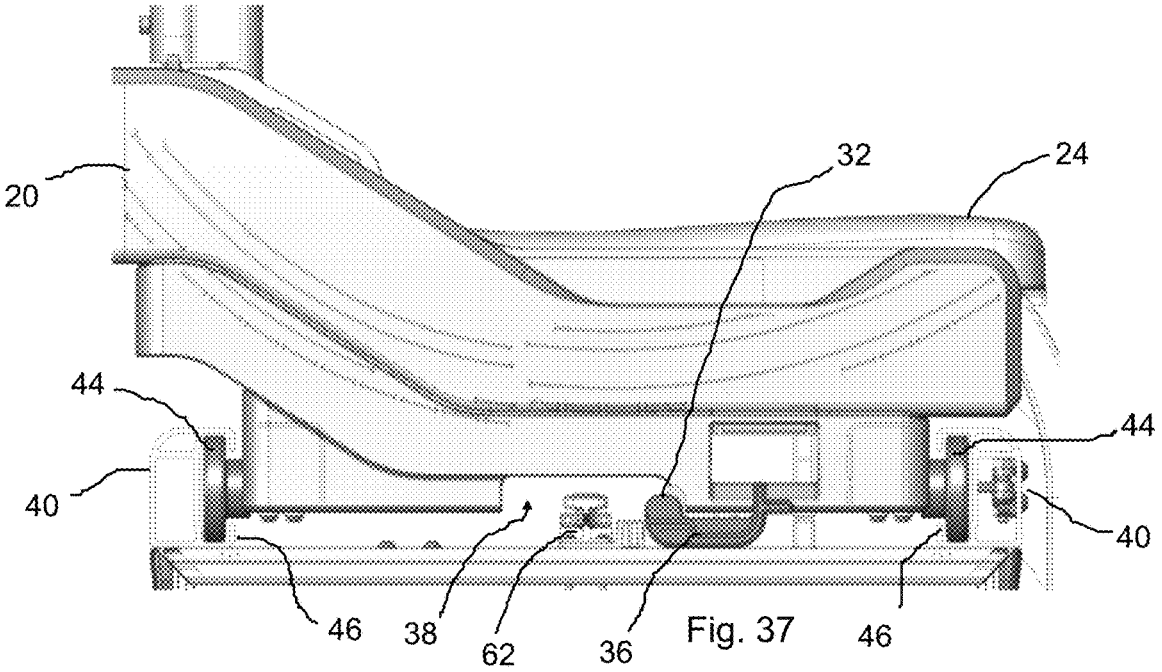
FIG. 37 is a right side view of the detail of FIG. 36.
Figure 38:
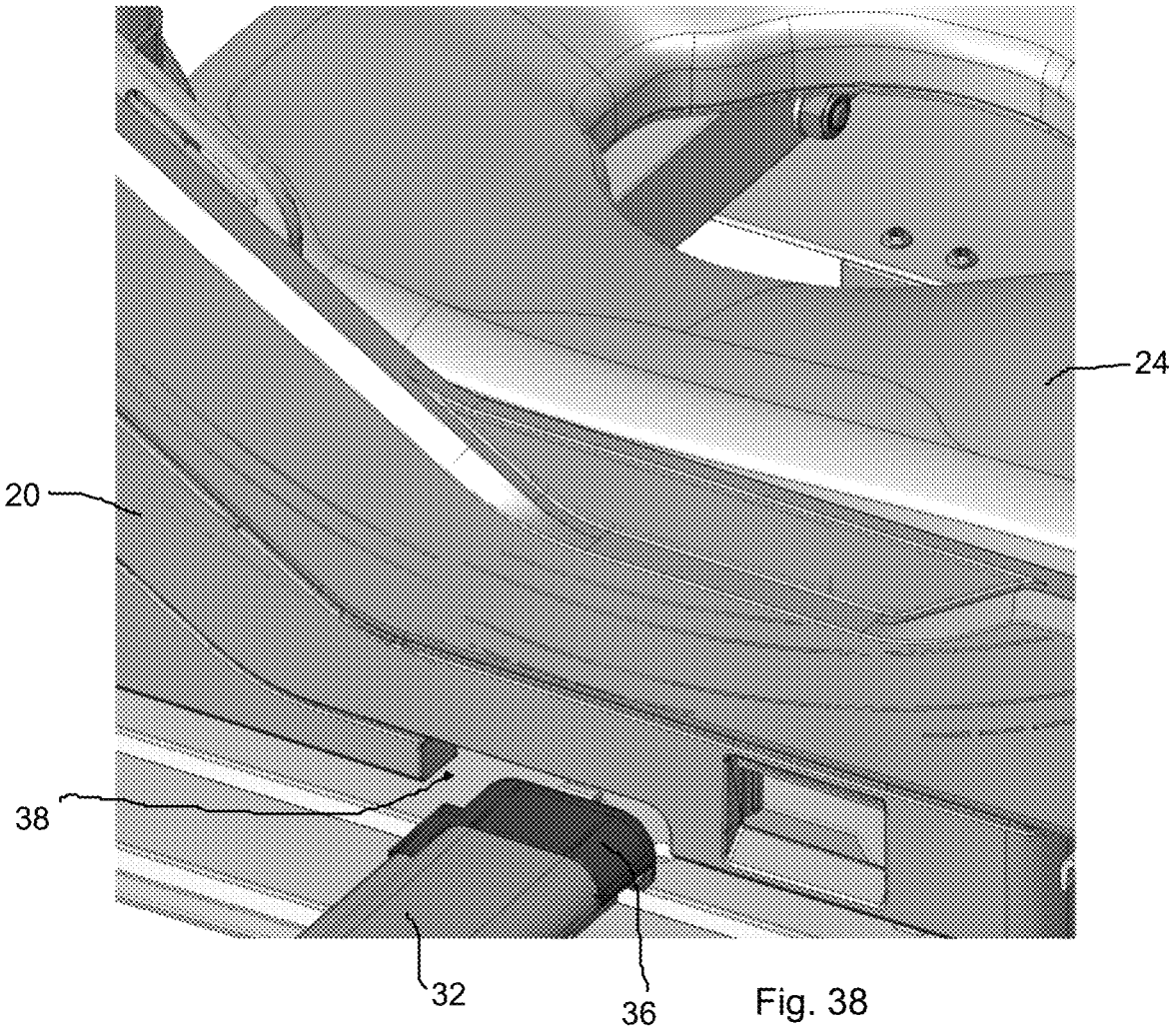
FIG. 38 is a perspective view of a detail of the transfer system of FIG. 2.
Figure 39:
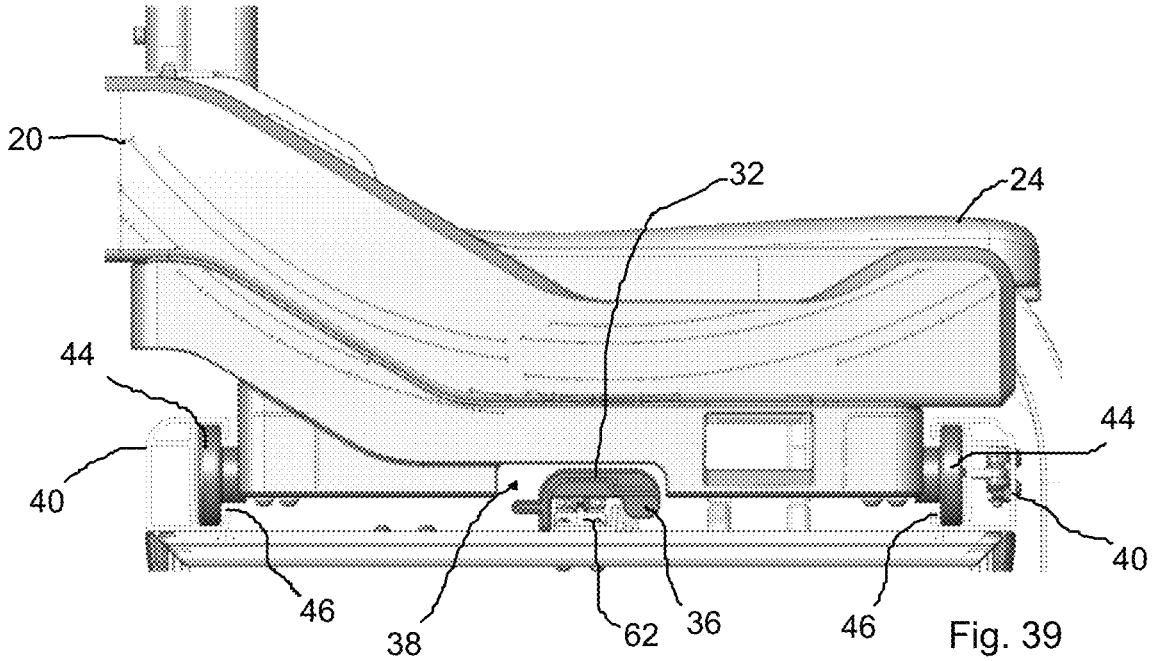
FIG. 39 is a right side view of the detail of FIG. 38.

As best seen in FIGS. 37 and 39, the rolling means may be provided in the form of wheels 44 or rollers, and the one or more track members 40 may be provided with a groove 46 for guiding the wheels 44 or rollers, according to preferred embodiments of the present invention. Most preferably, however, the rolling means will be in the form of wheels 44, and the groove 46 will be configured to retain the wheels 44 within the groove 46.

It is also contemplated that in other embodiments of the present invention, the bath transfer system 10 will have only one track 42, or that the track members 40 will not be aligned with one another along the path 22. All such embodiments are comprehended by the present invention. What is important is that when the removable bridge 16 is securely connected to the mobile base 14 and the stationary base 18, the chair 20 is movable along the path 20 from the mobile base 14, over the removable bridge 16, to the stationary base 18, and vice versa.

The mobile base 14 is configured to be moved on the ground when the removable bridge 16 is disconnected therefrom. For this reason, the preferred mobile base 14 may be fitted with rolling means, such as wheels 48, or rollers, for example, to facilitate movement of the mobile base 14 on a floor. Furthermore, when the chair 20 is supported on the mobile base 14, a disabled person may be seated in the chair 20 and maneuvered around along the floor from a position away from the bathroom facility 12, to a position adjacent to the bathroom facility 12, as shown in FIG. 1, for example.

On the other hand, the stationary base 18 is configured to remain in a fixed position relative to the bathroom facility 12. By way of example, the stationary base 18 may be disposed inside the bathroom facility 12, as shown in FIG. 1. In this example, the stationary base 18 is provided with legs 50 for keeping the stationary base 18 in a stationary position relative to the bathroom facility 12.

Preferably, the stationary base 18 may also be provided with one or more stabilizers 52 to help stabilize the stationary base 18, and keep it in a fixed horizontal position relative to the bathroom facility 12. In this example, the stabilizers 52 are tubes with telescopically extendible pads 54 configured to lock in one or more extended positions. Preferably, the extendible pads 54 may be extended to engage side walls of the bathroom facility 12, to limit the lateral movement of the stationary base 18 inside the bathroom facility 12. For example, if the bathroom facility 12 is a bathtub, as shown in FIG. 1, the stabilizers 52 may be configured to allow the extendible pads to engage opposed upstanding side walls of the bathtub. Most preferably, however, the stabilizers 52 may be configured to allow the extendible pads to be extended to press against the upstanding side walls of the bathroom facility 12 with sufficient force to frictionally affix the stationary base 18 to the bathroom facility 12.

Although, the preferred stationary base 18 is configured to be removably affixed to the bathroom facility 12, it will be appreciated that in some embodiments it may be desirable to have the stationary base 18 permanently affixed to the bathroom facility 12. All such embodiments are comprehended by the present invention.

Referring now to FIGS. 7 to 10, the bath transfer system 10 is shown with the removable bridge 16 connected to the mobile base 14 and the stationary base 18, and the chair 20 being supported by the mobile base 14, similar to FIGS. 2 to 5, except that the chair blocking member 32 is in the chair blocking position. With the chair blocking member 32 in the chair blocking position, the chair 20 is not movable from the mobile base 14 to the stationary base 18, or vice versa. When in the chair blocking position, the opposed ends 36 of the chair blocking member 32 physically interfere with movement of the chair 20 on to the removable bridge 16.

As best seen in FIGS. 9, 10, 36, and 37, the chair blocking member 32 is misaligned with the channel 38 in the bottom of the chair 20, preventing the chair 20 from passing over the opposed end 36 of the chair blocking member 32 adjacent the seat 24 of the chair 20, and proceed onto the removable bridge 16. In other words, even though the removable bridge 16 is connected to the mobile base 14, the chair 20 is nevertheless trapped on the mobile base 14 by the chair blocking member 32 being in the chair blocking position. Had the chair 20 been located on the stationary base 18, as opposed to the mobile base 14, then the chair 20 would have been trapped on the stationary base 18 by the chair blocking member 32 being in the chair blocking position. What is important is that even though the removable bridge 16 may be connected to the mobile base 14 and/or the stationary base 18, as a safety precaution, the chair 20 can not be moved onto the removable bridge 16 unless the connection is secured, and the chair blocking member 32 is in the chair unblocking position.

Figure 11:
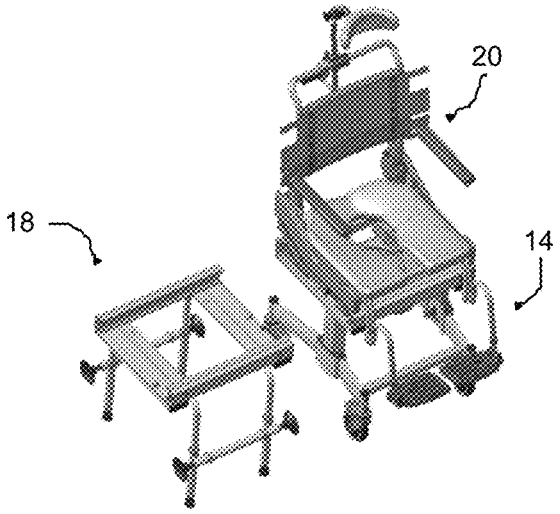
FIG. 11 is a perspective view of the transfer system of FIG. 7, after the removable bridge has been disconnected from the mobile base and the stationary base and removed.
Figure 12:
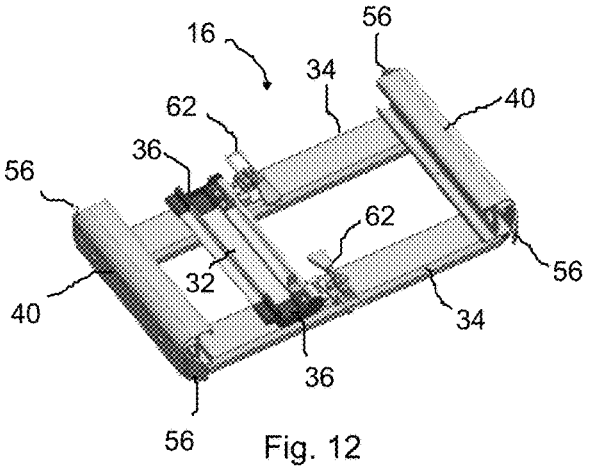
FIG. 12 is a perspective view of the removable bridge of FIG. 7 after having been removed from FIG. 11.

Referring now to FIG. 11, the removable bridge 16 is shown as having been disconnected from the mobile base 14 and the stationary base 18 and removed from the bath transfer system 10. FIG. 12 shows the removable bridge 16 on its own, after having been removed from the bath transfer system 10, freeing the mobile base 14 to be moved away from the stationary base 18. Preferably, each of the mobile base 14 and the stationary base 18 has a restraining means (not shown), to prevent the chair 20 from sliding off the mobile base 14 or the stationary base 18, as the case may be, after the removable bridge 16 is removed from the bath transfer system 10. For example, it is known to provide a retractable wheel blocker (not shown) in at least one of the track members 40 of the mobile base 14 which is biased to extend into the groove 46 of the at least one track member 40 to block a wheel 44 of the chair 20 in the groove 46, when the removable bridge 16 is not connected to the corresponding track member 40 of the mobile base 14. Similarly, it is known to provide a retractable wheel blocker (not shown) in at least one of the track members 40 of the stationary base 18 which is resiliently biased to extend into the groove 46 of the at least one track member 40 to block a wheel 44 of the chair 20 in the groove 46, when the removable bridge 16 is not connected to the corresponding track member 40 of the stationary base 18. In both cases, the retractable wheel blocker (not shown) is mechanically retracted from the groove 46 by paddles 56 extending from the ends of the corresponding track members 40 on the removable bridge, when the track members 40 of the removable bridge 16 are connected to the corresponding track members 40 on the mobile base 14 or the stationary base 18, as the case may be. Preferably, the engagement of the paddles 56 with the wheel blockers (not shown) forces the wheel blockers (not shown) to simply retract out of the groove 46, thereby freeing the wheel 44 of the chair 20 to be moved past the wheel blocker (not shown) in the groove 46.

Figure 13:
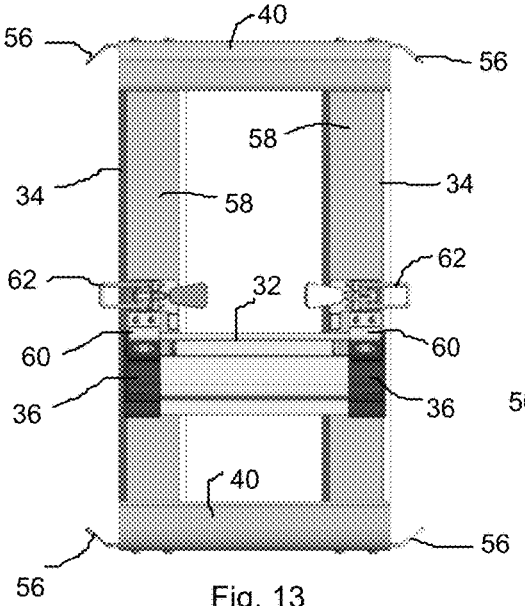
FIG. 13 is a top view of the removable bridge of FIG. 12.

Referring now to FIG. 13, the removable bridge 16 may have a pair of track members 40 attached to a pair of cross members 58, according to a preferred embodiment. As shown, the chair blocking member 32 is preferably attached to the cross members 58, positioned between the pair of track members 40. Preferably, the chair blocking member 32 may be attached with hinges 60, to enable pivotable movement of the chair blocking member 32 between the chair blocking position and the chair unblocking position. The chair blocking member 32 is shown in FIG. 13 in its chair blocking position. Although, the chair blocking member 32 is pivotably attached to the removable bridge 16, and pivotably movable between the chair blocking position and the chair unblocking position, according to a preferred embodiment of the present invention, the chair blocking member may be attached to the removable bridge 16 in other ways that allow the chair blocking member to be moved between the two positions. For example, as discussed in more detail below, the chair blocking member 32 may be slidably attached to the removable bridge 16, to allow slidable movement of the chair blocking member 32 between the chair blocking position and the chair unblocking position. All such embodiments are comprehended by the present invention.

Figure 14:
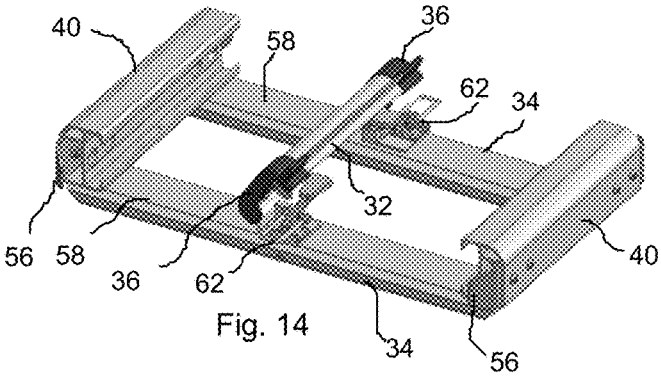
FIG. 14 is a perspective view of the removable bridge of FIG. 12, showing the latch members in their first positions interfering a movement of the chair blocking member to the fully closed, chair unblocking position.

As can also be seen in FIG. 13, the chair blocking member 32 is attached to the cross members 58 adjacent to a pair of latch members 62. The latch members 62 are part of a latch system 64 configured to secure the connection of the removable bridge 16 to the mobile base 14 and the stationary base 18. As shown in FIG. 14, the latch members 62 physically interfere with movement of the chair blocking member 32 from the chair blocking position to the chair unblocking position, when the removable bridge 16 is not securely connected to the mobile base 14 and the stationary base 18. FIG. 14 shows the chair blocking member 32 pivoted to a 45 degree angle, which in this example is the limit of its pivotable movement towards the chair unblocking position, when the removable bridge 16 is not securely connected to the mobile base 14 and the stationary base 18.

Referring now to FIGS. 15 to 20, the latching system 64 according to a preferred embodiment of the present invention includes a pair of latch members 62, each one attached to opposite ends 34 of the removable bridge 16 for latching to corresponding catch members 66 attached to the mobile base 14 and the stationary base 18. Preferably, the latch members 62 are draw latches. As will be appreciated, a draw latch is a two part latch where one part has an arm that can engage the other part, and as the draw latch closes the arm pulls the two parts together. Preferably, each draw latch 62 may have an arm with a catch member engagement member in the form of a hook or loop 68 configured to engage the corresponding catch member 66, and each catch member 66 may have a hook portion 70 configured for engagement by the hook or loop 68 of the draw latch 62.

Preferably, each of the latch members 62 is resiliently biased to a first position (best seen in FIGS. 15, 16, and 19), and movable to a second position (best seen in FIGS. 17, 18, and 20) by latching to the corresponding catch member 66. The first position of each of the latch members 62 interferes with a movement of the chair blocking member 32 to the chair unblocking position. In this way, the latching system 64 prevents the movement of the chair 20 onto the removable bridge 16 from the mobile base 14 and the stationary base 18 unless, for example, both of the latch members 62 are in their second positions, and the chair blocking member 32 is in its chair unblocking position.

FIGS. 23 to 30 show a latch member 62 according to a preferred embodiment of the present invention. As can be seen, the preferred latch members 62 have a body 72, a lever arm 74 pivotably attached to the body 72, a catch member engagement member in the form of a loop 68 attached to the lever arm 74, and a resiliently biasing means, such as for example, a spring 78, attached to the body 72. Preferably, the body 72 may be slidably carried by the removable bridge 16, as best seen in FIGS. 19 and 20.

As mentioned above, FIG. 19 shows a latch member 62 attached to the cross member 58 at the opposite end 34 of the removable bridge adjacent to the mobile base 14. A second latch member 62 is preferably attached to the cross member at the opposite end 34 of the removable bridge adjacent to the stationary base 18. Preferably, the latch members 62 are slidably carried by the cross members 58. Most preferably, the cross members 58 may have a hollow 76 configured to contain a portion of the body 72 of the latch member 62.

Figure 19:
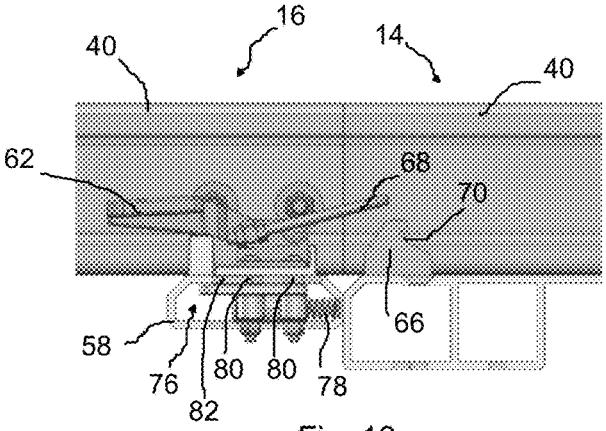
FIG. 19 is a side cross-sectional view of FIG. 15, taken along line 19-19, showing the latch member on the removable bridge in its first position, prior to being latched to the corresponding catch member on the mobile base.
Figure 20:
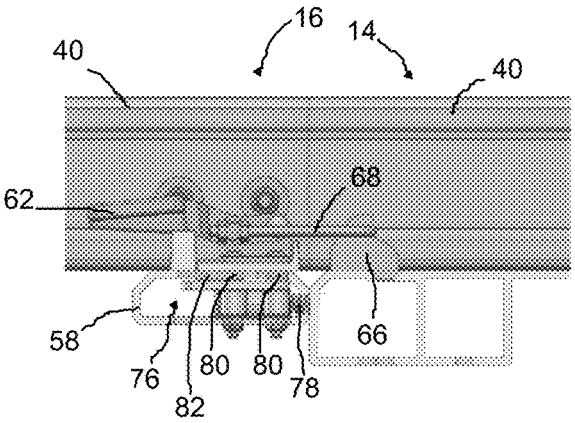
FIG. 20 is a side cross-sectional view of FIG. 17, taken along line 20-20, showing the latch member on the removable bridge in its second position, after being latched to the corresponding catch member on the mobile base.
Figure 21:
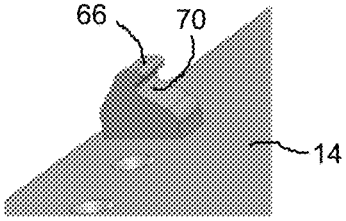
FIG. 21 is a perspective view of the catch member of FIG. 19, attached to the mobile base.
Figure 22:
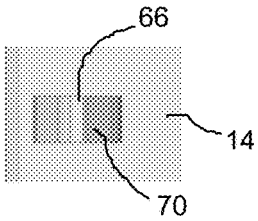
FIG. 22 is a top view of the catch member of FIG. 21.
Figure 23:
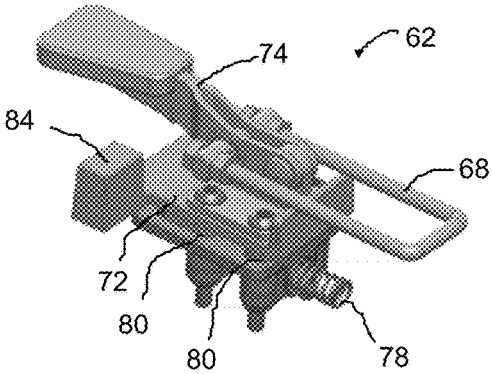
FIG. 23 is perspective view of the latch member of FIG. 15.
Figure 24:
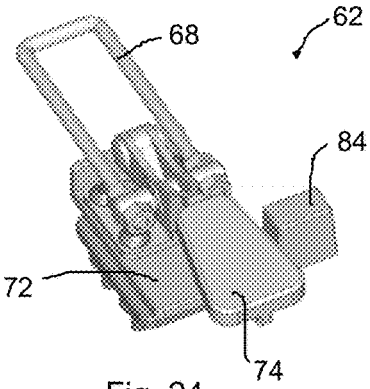
FIG. 24 is another perspective view of the latch member of FIG. 15.
Figure 25:
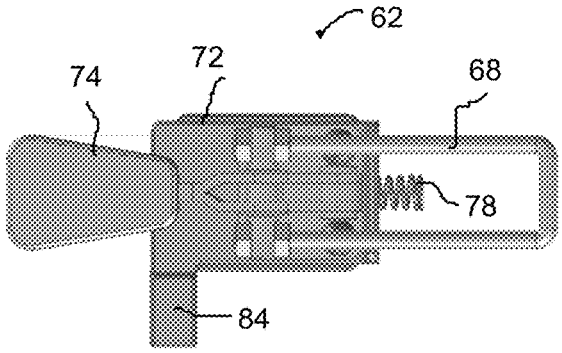
FIG. 25 is a top view of the latch member of FIG. 15.
Figure 26:
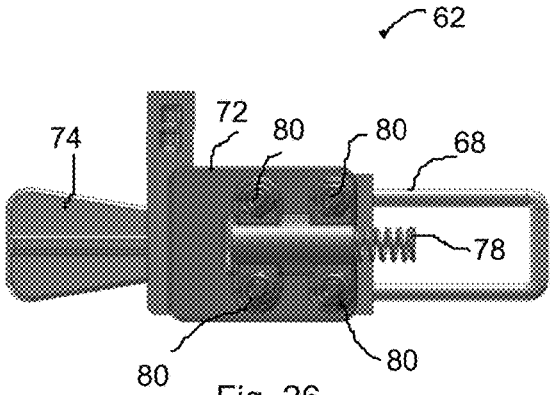
FIG. 26 is a bottom view of the latch member of FIG. 15.
Figure 27:
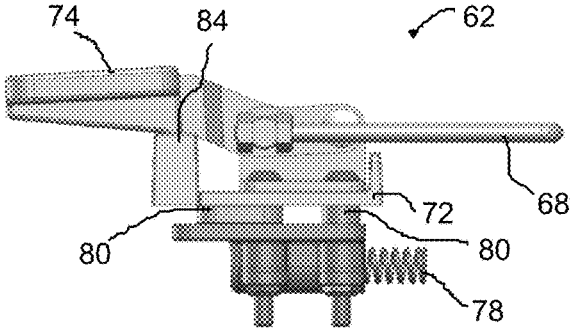
FIG. 27 is a right side view of the latch member of FIG. 15.
Figure 28:
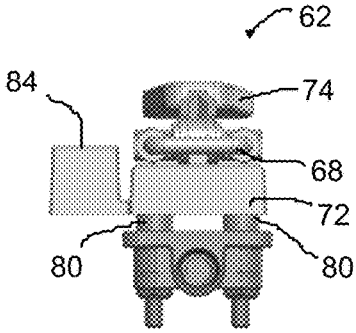
FIG. 28 is a front view of the latch member of FIG. 15.
Figure 29:
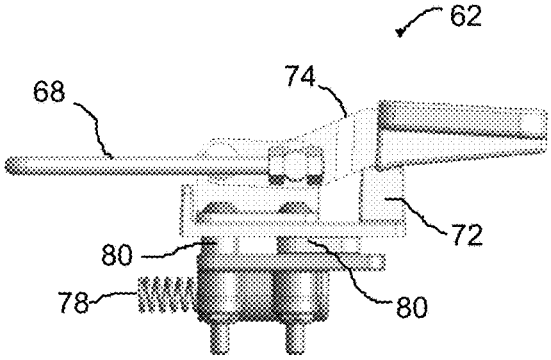
FIG. 29 is a left side view of the latch member of FIG. 15.
Figure 30:
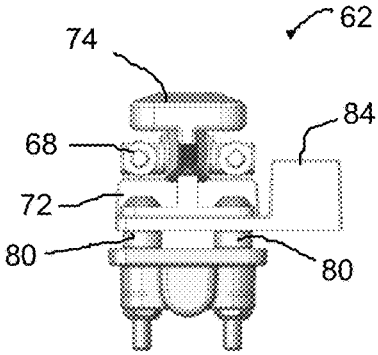
FIG. 30 is a rear view of the latch member of FIG. 15.
Figure 31:
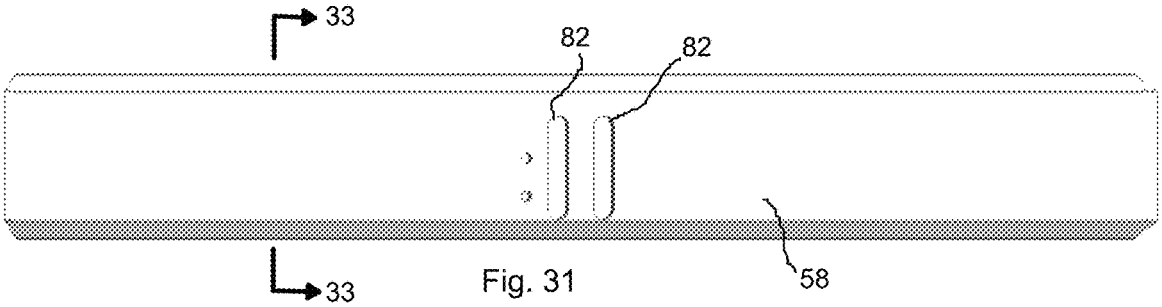
FIG. 31 is a top view of a cross-beam of the removable bridge of FIG. 12.
Figure 32:
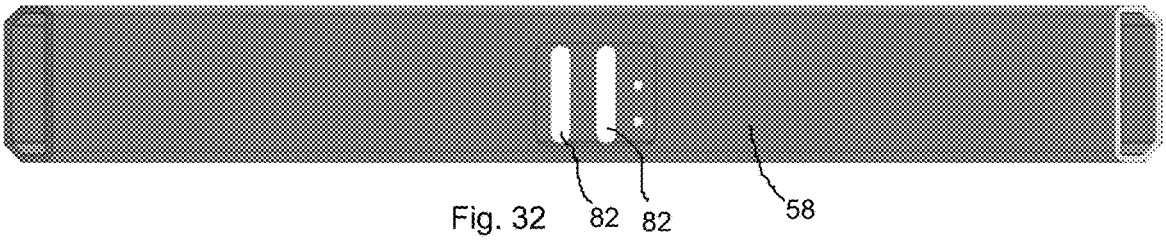
FIG. 32 is a bottom view of the cross-beam of FIG. 31.
Figure 33:
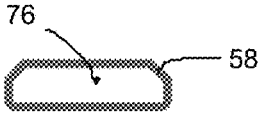
FIG. 33 is a cross-sectional view of the cross-beam of FIG. 31, taken along line 33-33.
Figure 34:
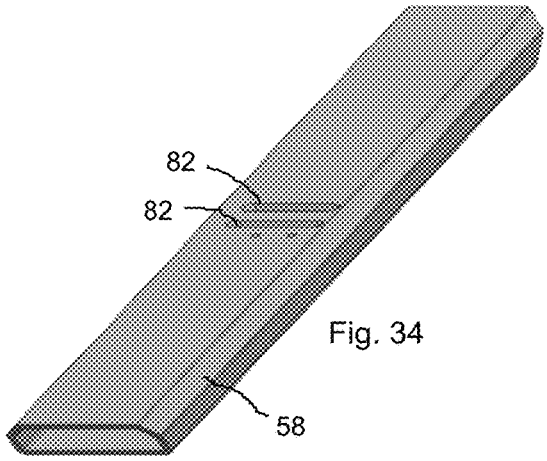
FIG. 34 is a perspective view of the cross-beam of FIG. 31.
Figure 35:
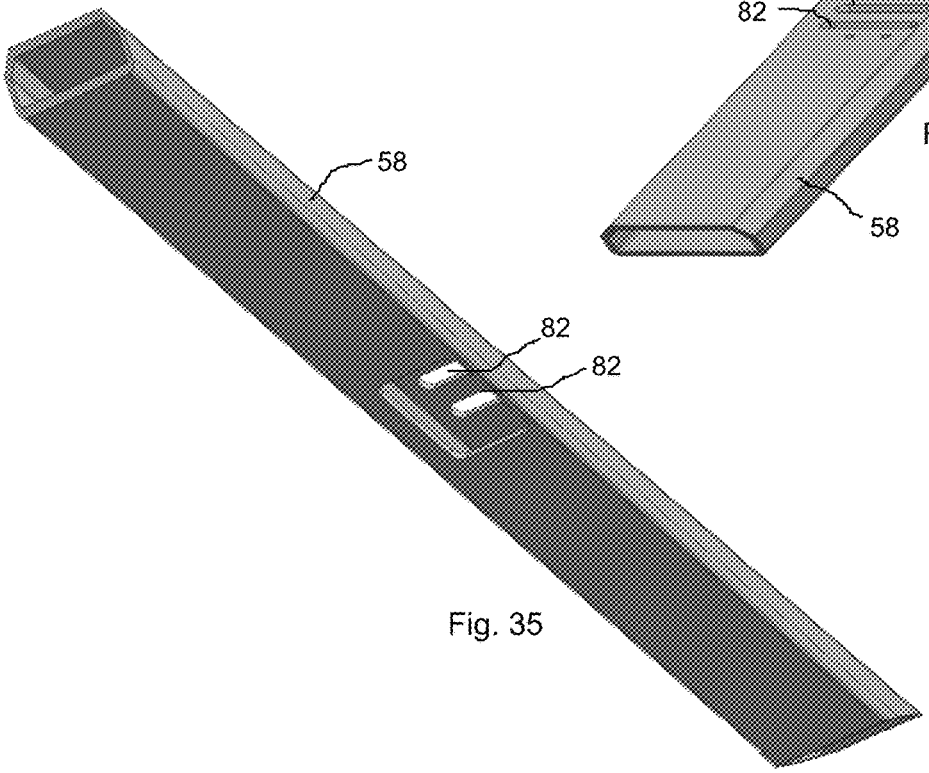
FIG. 35 is another perspective view of the cross-beam of FIG. 31.

The latch member 62 is shown in FIG. 19 in its natural first position prior to being latched to the corresponding catch member 66 on the mobile base 14. FIG. 20 shows the same latch member 62 after sliding to its second position, opposing the force of the resilient biasing means 78, as it was latched to the corresponding catch member 66 on the mobile base 14. Accordingly, it will now be appreciated that the latch members 62 are biased to their first positions, away from the corresponding catch members 66, while the act of latching the latch members 62 to the corresponding catch members 66, moves the latch members 62 to their second position, toward the corresponding catch members 66. Although not shown, it will be appreciated that the latching of the latch member 62 on the other opposite end 34 of the removable bridge 16 to the corresponding catch member 66 on the stationary base 18 works in the same manner.

Preferably, the latch members 62 may be provided with at least one guide member 80 on the body 72, and each cross member 58 may be provided with at least one guide slot 82 for receiving the at least one guide member 80. When provided, the guide members 80 and the guide slots 82 are configured and arranged to guide the latch members 62 when they are moved or biased between the first and second positions, so that they will move in a substantially straight line. Good results have been obtained by providing four guide members 80 on the body 72, and a pair of parallel guide slots 82 on the cross members 58. The guide members 80 on the latch members 62 are best seen in FIGS. 23 to 30, whereas the guide slots 82 on the cross members 58 are best seen in FIGS. 31 to 35.

It will now be appreciated that the connection of the removable bridge 16 to the mobile base 14 and the stationary base 18 may be secured with the latching system 64, by latching the latch members 62 to the corresponding catch members. Moreover, it will be understood that unless both latch members 62 are fully latched to the corresponding catch members 66 the latch members 62 will physically interfere with the movement of the chair blocking member 32 from the chair blocking position to the chair unblocking position.

Figure 15:
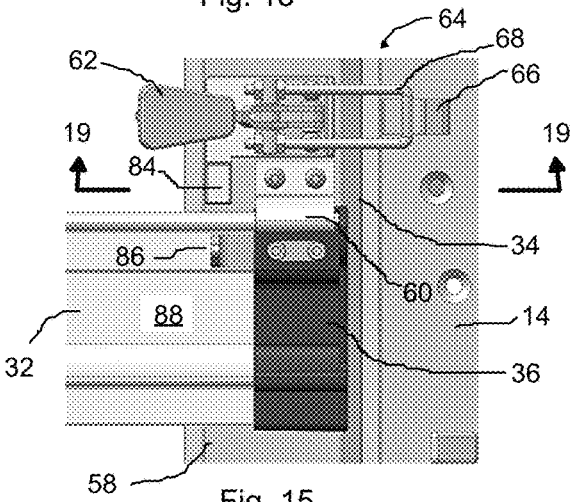
FIG. 15 is a top view of a detail of FIG. 8, showing a latch member on the removable bridge in its first position, prior to being latched to a corresponding catch member on the mobile base.
Figure 16:
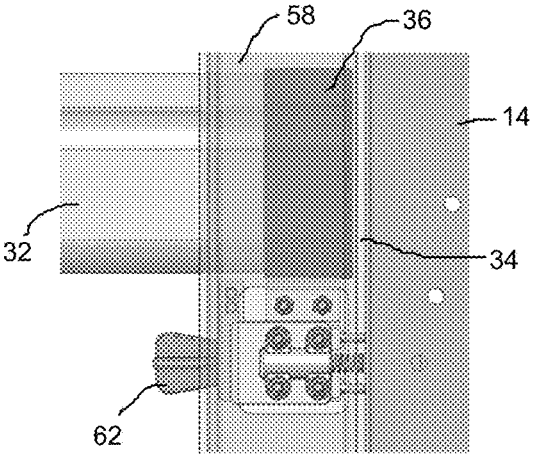
FIG. 16 is a bottom view of the detail of FIG. 15.

Referring then to FIG. 15 again, the chair blocking member 32 can be seen in the chair blocking position, the latch member 62 is unlatched from the corresponding catch member 66, and the latch member 62 is in its first position. Preferably, the latch member 62 includes a surface projecting from an exterior portion of its body 72, which is sized and positioned on the body to interfere with the movement of the chair blocking member 32 to the chair unblocking position, when the latch member 62 is in this first position. Most preferably, the surface 84 projects outwardly from the body 72, and when the latch member 62 is in its first position, the surface 84 will be aligned with a flange 86 projecting outwardly from the underside surface 88 of the chair blocking member 32, as shown in FIG. 15. The flange 86 is sized and positioned on the underside surface 88 of the chair blocking member 32, to engage the surface 84 when the latch member 62 is in the first position, and prevent the chair blocking member 32 from being movable to the chair unblocking position.

Figure 17:
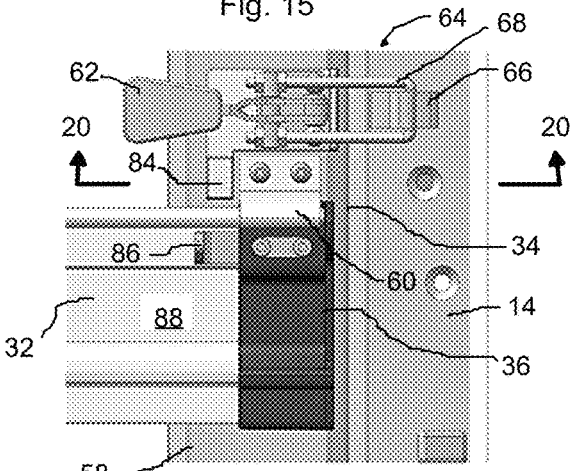
FIG. 17 is a top view of a detail of FIG. 8, showing the latch member on the removable bridge in its second position, after being latched to the corresponding catch member on the mobile base.
Figure 18:
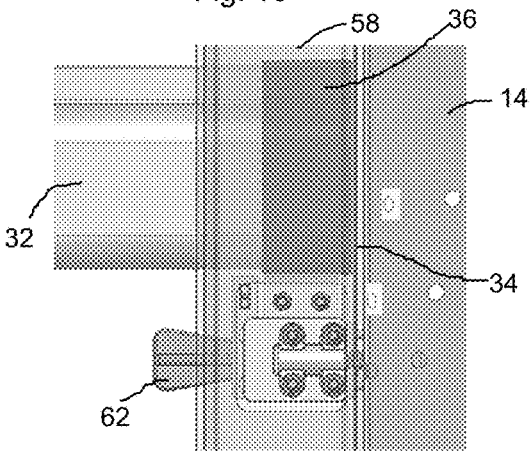
FIG. 18 is a bottom view of FIG. 17.

Referring now to FIG. 17, the chair blocking member 32 can be seen in the chair blocking position, the latch member 62 is properly latched to the corresponding catch member 66, and the latch member 62 has been moved from its first position (shown in FIG. 15) to its second position. Having been moved to the second position, it can be seen in FIG. 17 that the surface 84 on the body 72 of the latch member 62 is no longer aligned with the flange 86 projecting from the underside surface 88 of the chair blocking member 32. Having been moved out of the way, the surface 84 will no longer interfere with the movement of the chair blocking member 32 to the chair unblocking position, since the flange 86 will miss the surface 84 as the chair blocking member 32 is moved to the chair unblocking position with the latch member 62 being in the second position.

Of course the removable bridge 16 preferably includes a pair of latch members 62 attached at opposed ends 34 of the removable bridge 14 as shown in FIGS. 13 and 14, for example, and the chair blocking member 32 preferably includes a flange 86 at both opposed ends 36. Accordingly, both surfaces 84 of the pair of latch members 62 on the removable bridge must be moved out of the path of the respective flanges 86 by latching the latch members 62 to corresponding catch members 66, in order for the chair blocking member 32 to be movable to the chair unblocking position. Thus the connection of the removable bridge 16 to the mobile base 14 and the stationary base 18 must be secured with the latching system 64 at both opposite ends 34 of the removable bridge 16 before the chair 20 can be freed to move on the removable bridge 16 from either the mobile base 14 or the stationary base 18.

Referring back to FIGS. 1 and 2, the chair blocking member 32 may preferably be sized and shaped in the form of a cover for covering the latch members 62, when the latch members 62 are in their second positions, and properly latched to the corresponding catch members 66. Furthermore, when the chair blocking member 32 is provided as a cover, it may be configured to block access to the latch members 62 to prevent the latch members 62 to be unlatched from the corresponding catch members 66. Additionally, the cover may be provided with two separate sections that can be moved between the chair blocking and unblocking positions independently of one another, each section being positioned over a respective latch member 62.

However, the chair blocking member 32 need not be sized and shaped in the form of a cover. What is important is that the chair blocking member 32 presents opposed ends 36 sized and positioned to interfere with the movement the chair 20 when the removable bridge 16 is connected to the mobile base 14 or the stationary base 18, as the case may be, and the chair blocking member is in the chair blocking position. Accordingly, the chair blocking member 32 need not have a cover portion between the opposed ends 36, which is shown in the exemplary drawings. All such embodiments are comprehended by the present invention.

Having described embodiments of the bath transfer system 10, a method of assisting a disabled person with accessing a bathroom facility 12 is discussed next, according to an embodiment of the present invention. For example, a stationary base 18 may be provided in a fixed position relative to the bathroom facility 12. The disabled person may be seated in a chair 20 supported by a mobile base 14. The mobile base 14 may be maneuvered to a position adjacent to the bathroom facility 12 with the disabled person seated in the chair 20 and the chair 20 being supported by the mobile base 14. A first end 34 of a removable bridge 16 may be connected to the mobile base 14, and a second end 34 of the removable bridge 16 to the stationary base 18, such that the mobile base 14, the removable bridge 16, and the stationary base 18 together define a path 22 for the chair 20 to move along between the mobile base 14 and the stationary base 18. Preferably, the path 22 may be blocked with a chair blocking member 32 attached to the removable bridge 16, extending between opposite ends 34 of the removable bridge 16, to prevent the chair 20 from being moved onto the removable bridge 16 until the connection of the removable bridge 16 to the mobile base 14 and the stationary base 18 is secured. The chair blocking member 32 has opposed ends 36, and is movable between a) a chair blocking position, wherein the opposed ends 36 interfere with a movement of the chair 20 onto the removable bridge 16 from the mobile base 14 and the stationary base 18, and a chair unblocking position, wherein the opposed ends 36 remain clear of the chair 20 to permit the movement of the chair 20 onto the removable bridge 16 from the mobile base 14 and the stationary base 18.

Preferably, the method may further include the step of securing the connection by latching first and second latch members 62 attached to the opposite ends 34 of the removable bridge 16, to corresponding first and second catch members 66 attached to the mobile base 14 and the stationary base 18, each of the first and second latch members 62 being resiliently biased to a first position, and movable to a second position by the latching to the corresponding first or second catch member 66. The first position of each of the first and second latch members 62 interferes with a movement of the chair blocking member 32 to the chair unblocking position. In this way, movement of the chair 20 onto the removable bridge 16 from the mobile base 14 and the stationary base 18 is prevented unless both the first and second latch members 62 are in the second positions, and the chair blocking member 32 is in the chair unblocking position.

While reference has been made to various preferred embodiments of the invention other variations, implementations, modifications, alterations and embodiments are comprehended by the broad scope of the appended claims. Some of these have been discussed in detail in this specification and others will be apparent to those skilled in the art.

Figure 40:
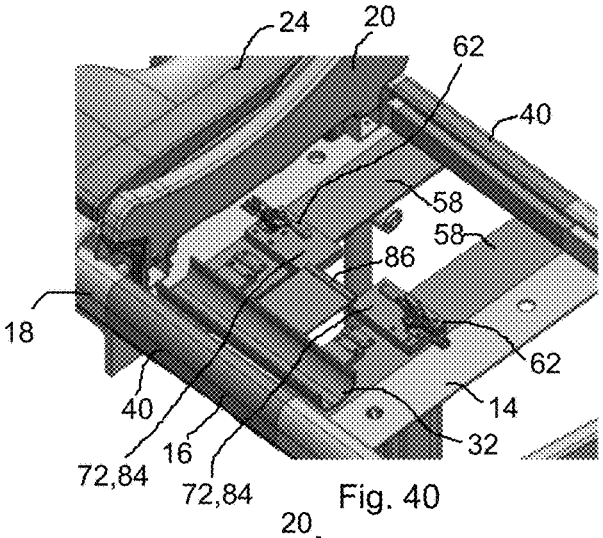
FIG. 40 is a perspective view of a detail of a transfer system according to another embodiment of the present invention, showing the chair blocking member of the latching system in the chair blocking position.
Figure 41:
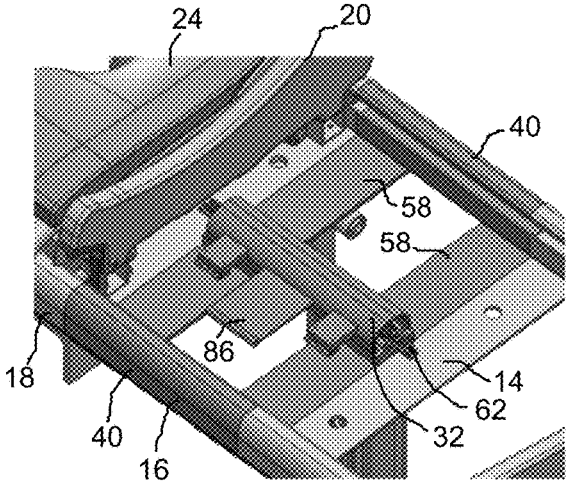
FIG. 41 is a perspective view of FIG. 40, showing the chair blocking member of the latching system in the chair unblocking position.

For example, FIGS. 40 and 41 show a pivotable chair blocking member 32 in a chair blocking position (FIG. 40), and a chair unblocking position (FIG. 41). In this embodiment, a single flange 86 is provided which extends laterally outward from the chair blocking member 32. The flange 86 is provided with a width such that when either latch member 62 is in its first position (unlatched) its body 72 interferes with the flange 86, thus preventing the chair blocking member 32 from being moved to the chair unblocking position. However, when both latch members 62 are moved to their second positions by latching to corresponding catch members 66, their bodies 72 move apart from one another sufficiently to allow the full width of the flange 86 to pass through the opening formed between them.

Figure 42:
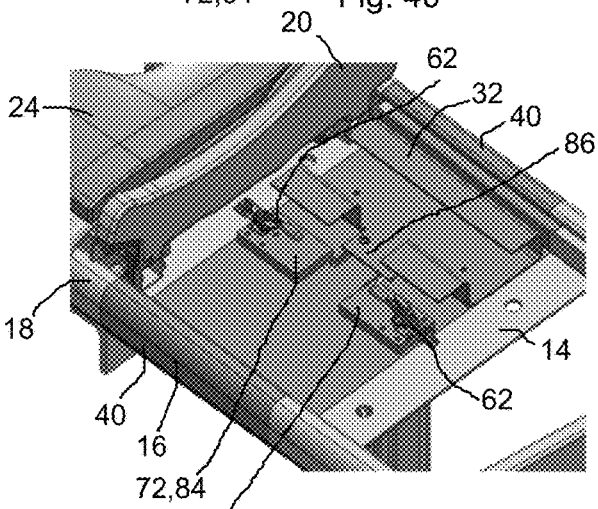
FIG. 42 is a perspective view of a detail of a transfer system according to another embodiment of the present invention, showing the chair blocking member of the latching system in the chair blocking position.
Figure 43:
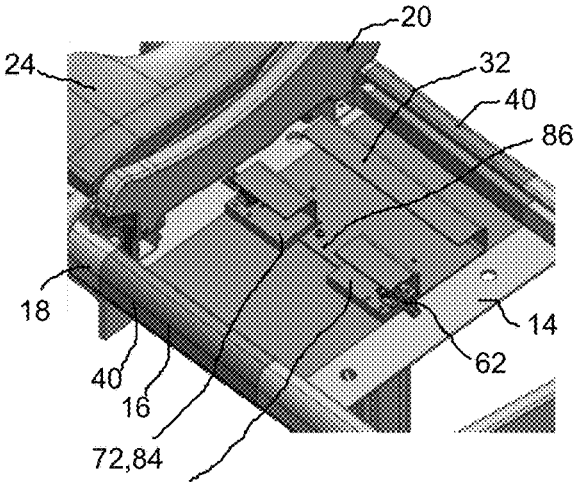
FIG. 43 is a perspective view of FIG. 42, showing the chair blocking member of the latching system in the chair unblocking position.

As another example, FIGS. 42 and 43 show a slidable chair blocking member 32 in a chair blocking position (FIG. 42), and a chair unblocking position (FIG. 43). In this embodiment, a single flange 86 is provided which extends laterally outward from the chair blocking member 32. The flange 86 is provided with a width such that when either latch member 62 is in its first position (unlatched) its body 72 interferes with the flange 86, thus preventing the chair blocking member 32 from being moved to the chair unblocking position. However, when both latch members 62 are moved to their second positions by latching to corresponding catch members 66, their bodies 72 move apart from one another sufficiently to allow the full width of the flange 86 to pass through the opening formed between them, without contacting their surfaces 84.

Figure 44:
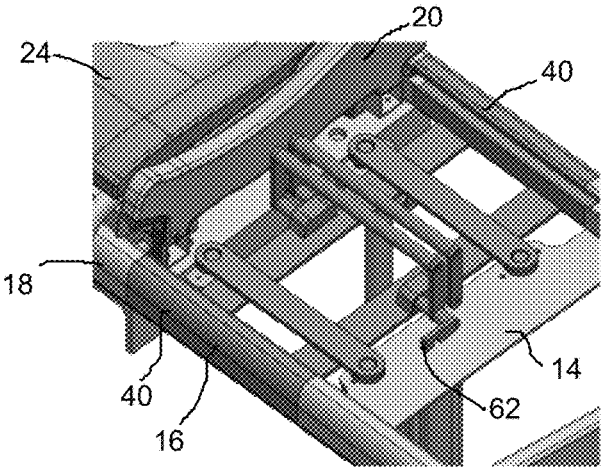
FIG. 44 is a perspective view of a detail of a transfer system according to another embodiment of the present invention, showing the chair blocking member of the latching system in the chair blocking position.
Figure 45:
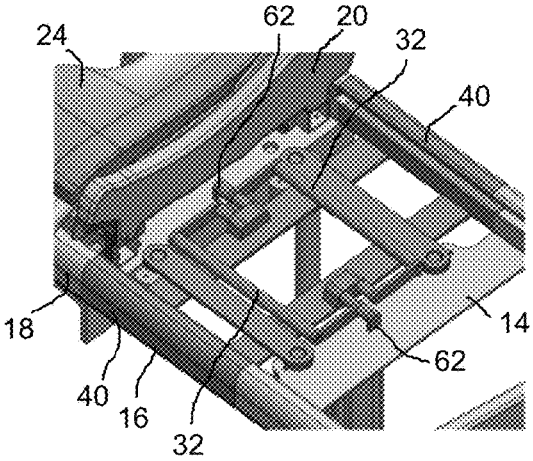
FIG. 45 is a perspective view of FIG. 44, showing the chair blocking member of the latching system in the chair unblocking position.

As yet another example, FIGS. 44 and 45 show a pair of pivotable chair blocking member 32 in chair blocking positions (FIG. 44), and chair unblocking positions (FIG. 45). In this embodiment, a latch member 62 is integrated with each chair blocking member 32, such that to unlatch a latch member 62 from its corresponding catch member 66, the respective chair blocking member 32 must be pivoted from the chair unblocking position to the chair blocking position, and vice versa. Additionally, this embodiment favours a simple latch 62 member with a hook, instead of the more complicated draw latch discussed above.

As well, it is contemplated that in some embodiments, the latching system may comprise only one latch member 62 and corresponding catch member 66 for securing the connection of the removable bridge 16 to either the mobile base 14, or the stationary base 18. All such embodiments are comprehended by the present invention.

Those of ordinary skill in the art having access to the teachings herein will recognize these additional variations, implementations, modifications, alterations and embodiments, all of which are within the scope of the present invention, which invention is limited only by the appended claims.

The invention claimed is:

1. A transfer system to assist a user with accessing a bathroom facility, said transfer system comprising:

a mobile base configured to be maneuvered to a position adjacent to said bathroom facility;

a stationary base configured to remain in a fixed position relative to said bathroom facility;

a removable bridge configured to connect said mobile base to said stationary base, such that said mobile base, said removable bridge, and said stationary base together define a path between said mobile base and said stationary base;

a chair for said user, said chair being movable along said path; and a chair blocking member attached to said removable bridge, extending between opposite ends of said removable bridge, said chair blocking member having opposed ends, and being movable between:

a) a chair blocking position, wherein at least one of said opposed ends interferes with a movement of said chair onto said removable bridge from said mobile base or said stationary base; and b) a chair unblocking position, wherein said opposed ends remain clear of said chair to permit said movement of said chair onto said removable bridge from said mobile base and said stationary base.

2. The transfer system as claimed in claim 1, further comprising a latching system configured to secure said connection of said removable bridge to said mobile base or said stationary base, said latching system comprising:

a first latch member attached to one of said opposite ends of said removable bridge for latching to corresponding first catch member attached to one of said mobile base and said stationary base, said first latch member being resiliently biased to a first position, and movable to a second position by latching to said corresponding catch member;

wherein said first position of said first latch member interfere with a movement of said chair blocking member to said chair unblocking position;

whereby said latching system prevents said movement of said chair onto said removable bridge from said mobile base or said stationary base unless said first latch member is in said second position, and said chair blocking member is in said chair unblocking position.

3. The transfer system as claimed in claim 2, wherein said latching system is configured to secure said connection of said removable bridge to said mobile base and said stationary base, said latching system further comprising:

a second latch member attached to the other of said opposite ends of said removable bridge for latching to a corresponding second catch member attached to the other of said mobile base and said stationary base, said second latch member being resiliently biased to a first position, and movable to a second position by latching to said corresponding catch member;

wherein said first position of said second latch member interferes with said movement of said chair blocking member to said chair unblocking position;

whereby said latching system prevents said movement of said chair onto said removable bridge from said mobile base and said stationary base unless both said first and second latch members are in said second positions, and said chair blocking member is in said chair unblocking position.

4. The transfer system as claimed in claim 3, wherein said first and second latch members are draw latches.

5. The transfer system as claimed in claim 3, wherein each said first and second latch member comprises:

a body;

a lever arm pivotably attached to said body;

a catch member engagement member attached to said lever arm; and a resiliently biasing means attached to said body;

wherein said body is slidably carried by said removable bridge.

6. The transfer system as claimed in claim 5, wherein said removable bridge comprises a cross-member at each of said opposite ends, and said first and second latch members are slidably carried by said cross-members.

7. The transfer system as claimed in claim 6, wherein each said cross-member comprises a hollow configured to contain a portion of said body of said corresponding first or second latch member.

8. The transfer system as claimed in claim 7, wherein each said first and second latch member further comprises at least one guide member on said body, and each said cross-member further comprises at least one guide slot for receiving said at least one guide member; and wherein said guide members and said guide slots are configured and arranged to guide said first and second latch members when moved or biased between said first and second positions.

9. The transfer system as claimed in claim 5, wherein each said first and second latch members further comprises a surface projecting from an exterior portion of said body, said surface being sized and positioned on said body to interfere with said movement of said chair blocking member to said chair unblocking position, when said first or second latch member is in said first position.

10. The transfer system as claimed in claim 3, wherein said chair blocking member is a cover for covering said first and second latch members, when both said first and second latch members are in said second position.

11. The transfer system as claimed in claim 10, wherein when said cover is in said chair unblocking position, said cover blocks access to said first and second latch members to prevent said first and second latch members to be unlatched from said corresponding first and second catch members.

12. The transfer system as claimed in claim 10, wherein said chair blocking member comprises a flange, and said latch member comprises a surface;

wherein said flange is sized and positioned to engage said surface when said latch member is in said first position, to prevent said chair blocking member from being movable to said chair unblocking position.

13. The transfer system as claimed in claim 10, wherein said flange projects outwardly from an underside surface of said chair blocking member.

14. The transfer system as claimed in claim 10, wherein said latch member has a body, and said surface projects outwardly from said body.

15. The transfer system as claimed in claim 1, wherein said path is defined by a plurality of track members comprising one or more track members on said mobile base, one or more track members on said removable bridge, and one or more track members on said stationary base; and wherein said chair has rolling means configured to engage said plurality of track members, to allow said chair to be moved along said path between said mobile base and said stationary base.

16. The transfer system as claimed in claim 15, wherein said rolling means comprise wheels or rollers; and wherein one or more of said track members comprise a groove for guiding said wheels or rollers.

17. The transfer system as claimed in claim 16, wherein said rolling means comprise wheels, and said groove is configured to retain said wheels within said groove.

18. The transfer system as claimed in claim 15, wherein each said draw latch has a hook or loop configured to engage said corresponding catch member.

19. The transfer system as claimed in claim 18, wherein each said catch member has a hook portion configured for engagement by said hook or loop of said draw latch.

20. The transfer system as claimed in claim 1, wherein said chair defines a void sized and shaped to allow said chair to pass over said opposed ends of said chair blocking member, when said chair blocking member is in said chair unblocking position.

21. The transfer system as claimed in claim 20, wherein said void is a channel formed in a bottom of said chair.

22. The transfer system as claimed in claim 1, wherein said chair blocking member is hingedly attached to said removable bridge, and pivotably movable between said chair blocking position and said chair unblocking position.

23. The transfer system as claimed in claim 1, wherein said chair blocking member is slidably attached to said removable bridge, and slidably movable between said chair blocking position and said chair unblocking position.

24. The transfer system as claimed in claim 1, wherein said opposed ends of said chair blocking member are adjacent said opposite ends of said removable bridge.

25. The transfer system as claimed in claim 1, wherein, when said chair blocking member is in said chair blocking position, one of said opposed ends interferes with said movement of said chair onto said removable bridge from said mobile base, and the other of said opposed ends interferes with said movement of said chair onto said removable bridge from said stationary base.

26. The transfer system as claimed in claim 1, wherein said bathroom facility is a bathtub, a shower stall, or a toilet.

27. The transfer system as claimed in claim 1, wherein said stationary base is configured to be removably affixed to said bathroom facility.

28. The transfer system as claimed in claim 27, wherein said stationary base is further configured to be disposed inside said bathroom facility.

29. The transfer system as claimed in claim 1, wherein said mobile base comprises rolling means to facilitate movement of said mobile base on a floor.

30. A method of assisting a user with accessing a bathroom facility, said method comprising the steps of:

providing a stationary base in a fixed position relative to said bathroom facility;

seating said user in a chair supported by a mobile base;

maneuvering said mobile base to a position adjacent to said bathroom facility with said user seated in said chair and said chair being supported by said mobile base;

connecting a first end of a removable bridge to said mobile base, and a second end of said removable bridge to said stationary base, such that said mobile base, said removable bridge, and said stationary base together define a path for said chair to move along between said mobile base and said stationary base;

blocking said path with a chair blocking member attached to said removable bridge, extending between opposite ends of said removable bridge, to prevent said chair from being moved onto said removable bridge until said connection of said removable bridge to said mobile base and said stationary base is secured;

wherein said chair blocking member has opposed ends, and is movable between:

a) a chair blocking position, wherein at least one of said opposed ends interferes with a movement of said chair onto said removable bridge from said mobile base or said stationary base; and b) a chair unblocking position, wherein said opposed ends remain clear of said chair to permit said movement of said chair onto said removable bridge from said mobile base and said stationary base.

31. The method as claimed in claim 30, further comprising the step of:

securing said connection by latching a first latch member attached to one of said opposite ends of said removable bridge to a corresponding first catch member attached to one of said mobile base and said stationary base, said first latch member being resiliently biased to a first position, and movable to a second position by said latching to said corresponding first catch member;

wherein said first position of said first latch member interferes with said movement of said chair blocking member to said chair unblocking position;

whereby said method prevents said movement of said chair onto said removable bridge from said mobile base or said stationary base unless said first latch member is in said second position, and said chair blocking member is in said chair unblocking position.

32. The method as claimed in claim 31, further comprising the step of:

securing said connection by latching a second latch member attached to the other of said opposite ends of said removable bridge to a corresponding second catch member attached to the other of said mobile base and said stationary base, said second latch member being resiliently biased to a first position, and movable to a second position by said latching to said corresponding second catch member;

wherein said first position of said second latch member interferes with said movement of said chair blocking member to said chair unblocking position;

whereby said method prevents said movement of said chair onto said removable bridge from said mobile base and said stationary base unless both said first and second latch members are in said second positions, and said chair blocking member is in said chair unblocking position.

33. The method as claimed in claim 32, wherein said first and second latch members are draw latches.

34. The method as claimed in claim 33, wherein each said draw latch has a hook or a loop configured to engage said corresponding catch member.

35. The method as claimed in claim 32, wherein said blocking step comprises the steps of:

moving said chair blocking member to said chair blocking position;

allowing one of a) said first latch member to be biased to said first position by unlatching said first latch member from said corresponding first catch member, and b) said second latch member to be biased to said first position by unlatching said second latch member from said corresponding second catch member.

36. The method as claimed in claim 35, wherein said blocking step further comprises the step of:

allowing the other of a) said first latch member to be biased to said first position by unlatching said first latch member from said corresponding first catch member, and b) said second latch member to be biased to said first position by unlatching said second latch member from said corresponding second catch member.

37. The method as claimed in claim 32, comprising the step of:

interfering with said movement of said chair blocking member to said chair unblocking position with a surface of said first or said second latch member in said first position.

38. The method as claimed in claim 32, further comprising the step of:

unblocking said path by moving said chair blocking member to said chair unblocking position after moving said first and second latch members to said second positions by said latching to said corresponding first and second catch members.

39. The method as claimed in claim 32, comprising the step of:

forming said chair blocking member into a cover for covering said first and second latch members, when both said first and second latch members are in said second position.

40. The method as claimed in claim 39, wherein when said cover is in said chair unblocking position, said cover blocks access to said first and second latch members to prevent said first and second latch members to be unlatched from said corresponding first and second catch members.

41. The method as claimed in claim 39, comprising the step of:

providing a flange on said chair blocking member, said flange being sized and positioned to engage a surface of said first or second latch member when said first or second latch member is in said first position, to prevent said chair blocking member from being movable to said chair unblocking position.

42. The method as claimed in claim 41, wherein said flange projects outwardly from an underside surface of said cover.

43. The method as claimed in claim 41, wherein said surface projects outwardly from a body of said first or second latch member.

44. The method as claimed in claim 31, further comprising the step of:

forming a void in said chair, said void being sized and shaped to allow said chair to pass over said opposed ends of said chair blocking member, when said chair blocking member is in said chair unblocking position.

45. The method as claimed in claim 44, wherein said void is a channel formed in a bottom of said chair.

46. The method as claimed in claim 30, wherein said path is defined by a plurality of track members comprising one or more track members on said mobile base, one or more track members on said removable bridge, and one or more track members on said stationary base; and wherein said chair has rolling means configured to engage said plurality of track members, to allow said chair to be moved along said path between said mobile base and said stationary base.

47. The method as claimed in claim 46, wherein said rolling means comprise wheels or rollers; and wherein one or more of said track members comprise a groove for guiding said wheels or rollers.

48. The method as claimed in claim 30, comprising the step of:

hingedly attaching said chair blocking member to said removable bridge, to enable pivotable movement of said chair blocking member between said chair blocking position and said chair unblocking position.

49. The method as claimed in claim 30, comprising the step of:

slidably attaching said chair blocking member to said removable bridge, to enable slidable movement of said chair blocking member between said chair blocking position and said chair unblocking position.

50. The method as claimed in claim 30, comprising the step of:

providing said opposed ends of said chair blocking member adjacent said opposite ends of said removable bridge.

51. The method as claimed in claim 30, wherein, when said chair blocking member is in said chair blocking position, one of said opposed ends interferes with said movement of said chair onto said removable bridge from said mobile base, and the other of said opposed ends interferes with said movement of said chair onto said removable bridge from said stationary base.

52. The method as claimed in claim 30, wherein said bathroom facility is a bathtub, a shower stall, or a toilet.

53. The method as claimed in claim 30, comprising the step of:

removably affixing said stationary base to said bathroom facility.

54. The method as claimed in claim 53, further comprising the step of:

disposing said stationary base inside said bathroom facility.

* * * * *